US006828736B2

(12) United States Patent
Homma

(10) Patent No.: US 6,828,736 B2
(45) Date of Patent: Dec. 7, 2004

(54) PLASMA DISPLAY PANEL, METHOD OF DRIVING THE SAME, AND CIRCUIT FOR DRIVING THE SAME

(75) Inventor: Hajime Homma, Tokyo (JP)

(73) Assignee: NEC Plasma Display Corporation, Tokyo (JP)

( * ) Notice: Subject to any disclaimer, the term of this patent is extended or adjusted under 35 U.S.C. 154(b) by 148 days.

(21) Appl. No.: 10/354,010

(22) Filed: Jan. 30, 2003

(65) Prior Publication Data

US 2003/0141824 A1 Jul. 31, 2003

(30) Foreign Application Priority Data

Jan. 31, 2002 (JP) ..... 2002-024487

(51) Int. Cl.[7] ..... G09G 3/10

(52) U.S. Cl. ..... 315/169.4; 315/169.1; 313/582; 313/585

(58) Field of Search ..... 315/169.1, 169.3, 315/169.4; 313/494, 498, 499, 582, 585, 586, 587; 345/55, 60, 63

(56) References Cited

U.S. PATENT DOCUMENTS

| | | | | |
|---|---|---|---|---|
| 4,638,218 A | * | 1/1987 | Shinoda et al. | 315/169.4 |
| 6,333,599 B1 | * | 12/2001 | Kawanami et al. | 313/582 |
| 6,512,337 B2 | * | 1/2003 | Hirano et al. | 315/169.4 |
| 6,586,879 B1 | * | 7/2003 | Shino et al. | 313/582 |

FOREIGN PATENT DOCUMENTS

| | | |
|---|---|---|
| JP | 5-135701 A | 6/1993 |
| JP | 2674485 B2 | 7/1997 |
| JP | 9-330665 A | 12/1997 |
| JP | 11-202831 A | 7/1999 |
| JP | 3036496 B2 | 2/2000 |
| JP | 2000-113827 A | 4/2000 |
| JP | 2000-156167 A | 6/2000 |
| JP | 2000-195431 A | 7/2000 |
| JP | 2000-214822 A | 8/2000 |
| JP | 2000-267627 A | 9/2000 |
| JP | 2000-294149 A | 10/2000 |

* cited by examiner

*Primary Examiner*—Don Wong
*Assistant Examiner*—Jimmy T. Vu
(74) *Attorney, Agent, or Firm*—Sughrue Mion, PLLC

(57) ABSTRACT

A plasma display panel including a plurality of cells arranged in a matrix, wherein each of the cells includes (a) a scanning electrode having partial cutout, (b) a sustaining electrode having partial cutout, spaced away from the scanning electrode by a discharge gap in mirror-symmetry with a centerline of the discharge gap extending in a first direction, (c) a first trace electrode extending in the first direction on the opposite side of the scanning electrode about the discharge gap such that the first trace electrode makes electrical contact with the scanning electrode and further with a scanning electrode of an adjacent cell, and (d) a second trace electrode extending in the first direction on the opposite side of the sustaining electrode about the discharge gap such that the second trace electrode makes electrical contact with the sustaining electrode and further with a sustaining electrode of an adjacent cell.

35 Claims, 18 Drawing Sheets

PLASMA DISPLAY PANEL, METHOD OF DRIVING THE SAME, AND CIRCUIT FOR DRIVING THE SAME

BACKGROUND OF THE INVENTION

1. Field of the Invention

The invention relates to a plasma display panel (PDP) used as a planar display for a television set and a computer, a method of driving the same, a circuit for driving the same, and a display unit including the same. More particularly, the invention relates to an alternating current (AC) memory operation type plasma display panel, a method of driving the same, a circuit for driving the same, and a display unit including the same.

2. Description of the Related Art

A plasma display panel has many advantages that it can be fabricated thin, it can display images without flickers, it presents a high display contrast, it can be fabricated in a relatively large display screen, it has a high response speed, it presents superior visibility because it emits lights, and it can display color images by means of three phosphors for converting ultra-violet rays into visible lights of three primary colors, that is, red, green and blue. Hence, a plasma display panel is used as a display unit in a computer, a work station, a television set, and so on.

A plasma display panel is grouped into an alternating current (AC) type one in which electrodes covered with dielectric material are operated indirectly in AC discharge condition, and a direct current (DC) type one in which electrodes are exposed to a discharge space, and operated in DC discharge condition. An alternating current type plasma display panel is further grouped into a memory operation type one which makes use of a memory function by which sustaining discharge is continued in a cell, and a refresh operation type one which makes no use of the above-mentioned memory function. Herein, a cell means a minimum unit for constituting a display screen. A display screen is comprised of a plurality of cells arranged in a matrix.

In a plasma display panel, a luminance of each of colors displayed in each of cells is in proportion to the number of sustaining pulses. Since the above-mentioned refresh operation type plasma display panel makes no use of the memory function, if a display capacity is increased, a luminance would be reduced. Accordingly, when images are displayed with a high luminance and in a large capacity, a memory operation type plasma display panel is predominantly used.

FIG. 1 is a partial perspective view of a structure of a conventional alternating current (AC) memory operation type plasma display panel 1, and FIG. 2 is an upper view of the conventional plasma display panel 1 with a later mentioned front insulating substrate 2 being removed.

A conventional plasma display panel 1 such as one illustrated in FIGS. 1 and 2 is suggested, for instance, in Japanese Patent No. 3036496 (Japanese Patent Application Publication No. 11-161226) or Japanese Patent Application Publication No. 11-202831. FIG. 2 is an upper view obtained when the conventional plasma display panel 1 illustrated in FIG. 1 is rotated by 90 degrees.

The conventional plasma display panel 1 includes a front insulating substrate 2 and a rear insulating substrate 10. As illustrated in FIGS. 1 and 2, a plurality of stripe-shaped scanning electrodes 3 and a plurality of stripe-shaped sustaining electrodes 4 are alternately arranged in a row direction (an up to down direction in FIG. 1) on a lower surface of the front insulating substrate 2. Both of the scanning electrodes 3 and the sustaining electrodes 4 extend in a column direction (a left to right direction in FIG. 1). Each of the scanning electrodes 3 is spaced away from the adjacent sustaining electrodes 4 by a discharge gap 5. The front insulating substrate 2 is composed, for instance, of soda-lime glass, similarly to the rear insulating substrate 10. The scanning electrodes 3 and the sustaining electrodes 4 are comprised of an electrically conductive transparent thin film composed, for instance, of tin oxide, indium oxide or indium tin oxide (ITO).

A first trace electrode 6 extends in the column direction along an edge of and on a lower surface of each of the scanning electrodes 3. Similarly, a second trace electrode 7 extends in the column direction along an edge of and on a lower surface of each of the sustaining electrodes 4. The first and second trace electrodes 6 and 7 are comprised of a metal film such as a thick silver film or a thin aluminum or copper film. The first and second trace electrodes 6 and 7 reduce electrical resistance between the scanning and sustaining electrodes 3 and 4 both having a low electrical conductivity, and a later mentioned driver circuit electrically connected to the scanning and sustaining electrodes 3 and 4.

A lower surface of the front insulating substrate 2, the scanning electrodes 3, the sustaining electrodes 4, the first trace electrodes 6 and the second trace electrodes 7 are covered with a transparent dielectric layer 8. The transparent dielectric layer 8 is composed of glass having a low melting point, for instance.

The transparent dielectric layer 8 is covered with a protection layer 9 which protects the dielectric layer 8 from ion bombardment in discharge. The protection layer 9 is composed of a material having a high secondary electron emission coefficient and a high resistance to sputtering, such as magnesium oxide.

On an upper surface of the rear insulating substrate 10 is formed a plurality of stripe-shaped data electrodes 11 equally spaced away from one another and extending in the row direction, that is, a direction perpendicular to a direction in -which the scanning electrodes 3 and the sustaining electrodes 4 extend. The data electrodes 11 are comprised of a silver film, for instance.

The data electrodes 11 and an upper surface of the rear insulating substrate 10 are covered with a white dielectric layer 12.

On an upper surface of the dielectric layer 12 is formed a plurality of stripe-shaped partition walls 13 extending in the row direction. When viewed from an upper side, the partition walls 13 are arranged between the adjacent data electrodes 11. The partition walls 13 partition a cell.

Three phosphor layers 14R, 14G and 14B are formed on an upper surface of the dielectric layer 12 and sidewalls of the partition walls 13. The three phosphor layers 14R, 14G and 14B convert ultra-violet rays produced by gas discharge, into three visible lights of three primary colors, that is, red (R), green (G) and blue (B). The phosphor layers 14R, 14G and 14B are arranged in the column direction repeatedly in this order. Each of the three phosphor layers 14R, 14G and 14B extends in the raw direction.

Each of spaces surrounded by a lower surface of the protection layer 9, each of surfaces of the phosphor layers 14R, 14G and 14B, and sidewalls of the adjacent partition walls 13 defines a discharge gas space 15. The discharge gas space 15 is filled with discharge gas comprised of xenon (Xe), helium (He) or neon (Ne) alone or in combination at a predetermined pressure. A region surrounded by the scanning electrodes 3, the sustaining electrodes 4, the first trace electrode 6, the second trace electrode 7, the data electrodes 11, the phosphor layer 14R, 14G or 14B, and the discharge gas space 15 defines a cell.

FIG. 3 is a block diagram of the conventional plasma display panel 1 illustrated in FIG. 1, and a conventional driver circuit for driving the plasma display panel 1.

The plasma display panel 1 illustrated in FIG. 3 includes N scanning electrodes $\mathbf{3}_1$ to $\mathbf{3}_N$ equally spaced away from one another and extending in the column direction wherein N is an integer equal to or greater than one (1), N sustaining electrodes $\mathbf{4}_1$ to $\mathbf{4}_N$ equally spaced away from one another and extending in the column direction, and M data electrodes $\mathbf{11}_1$ to $\mathbf{11}_M$ equally spaced away from one another and extending in the row direction wherein M is an integer equal to or greater than one (1). Accordingly, the plasma display panel 1 includes (N×M) cells.

The driver circuit is comprised of an image processor 21, a drive controller 22, a sustaining electrode driver 23, a scanning electrode driver 24, and a data driver 25.

The image processor 21 receives an analog image signal Sp transmitted from an external circuit (not illustrated), and applies analog-digital conversion to the analog image signal Sp to thereby produce digital image data Dp for driving the plasma display panel 1. The image processor 21 further produces data Ds indicative of the number of sustaining pulses which determines a luminance of each of colors displayed in each of the cells in the plasma display panel 1.

The drive controller 22 produces a sustaining electrode driver control signal $S_{SU}$ for controlling the sustaining electrode driver 23, scanning electrode driver control signals $S_{SC1}$ to $S_{SC4}$ for controlling the scanning electrode driver 24, and a data driver control signal $S_{DD}$ for controlling the data driver 25, based on the digital image data Dp and the data Ds both received from the image processor 21.

The sustaining electrode driver 23 is comprised of a sustaining driver 26 electrically connected at one end thereof to the sustaining electrodes $\mathbf{4}_1$ to $\mathbf{4}_N$.

The sustaining driver 26 produces a sustaining pulse $P_{SU}$ having a predetermined waveform, based on the sustaining electrode driver control signal $S_{SU}$ received from the drive controller 22, and applies the sustaining pulse $P_{SU}$ to the sustaining electrodes $\mathbf{4}_1$ to $\mathbf{4}_N$.

The scanning electrode driver 24 is comprised of a scanning base driver 27, a sustaining driver 28, an erasion driver 29, a priming driver 30, and a scanning pulse driver 31.

The scanning base driver 27 produces scanning base pulses, based on the scanning electrode driver control signals $S_{SC1}$ transmitted from the drive controller 22.

The sustaining driver 28 produces sustaining pulses, based on the scanning electrode driver control signals $S_{SC2}$ transmitted from the drive controller 22.

The erasion driver 29 produces erasion pulses, based on the scanning electrode driver control signals $S_{SC3}$ transmitted from the drive controller 22.

The priming driver 30 produces priming pulses, based on the scanning electrode driver control signals $S_{SC4}$ transmitted from the drive controller 22.

The scanning pulse driver 31 produces scanning pulses $P_{SC1}$ to $P_{SCN}$ each having a predetermined waveform, based on the scanning base pulses transmitted from the scanning base driver 27, the sustaining pulses transmitted from the sustaining driver 28, the erasion pulses transmitted from the erasion driver 29, and the priming pulses transmitted from the priming driver 30, and applies the thus produced scanning pulses $P_{SC1}$ to $P_{SCN}$ to the scanning electrodes $\mathbf{3}_1$ to $\mathbf{3}_N$, respectively.

The data driver 25 produces data pulses having different waveforms from one another, based on the data driver control signal $S_{DD}$ transmitted from the drive controller 22, and applies the thus produced data pulses to the data electrodes $\mathbf{11}_1$ to $\mathbf{11}_M$.

FIG. 4 is a block diagram of the image processor 21.

The image processor 21 operates in accordance with a peak luminance enhancement (PLE) process in which a luminance level of a display screen is controlled in accordance with an average peak luminance (APL) level of the image signal Sp to thereby suppress an increase in power consumption and accomplish a high peak luminance.

The image processor 21 is comprised of a first circuit 32 for processing image signals, a second circuit 33 for carrying out operation, a third circuit 34 for controlling the number of sustaining pulses, and a fourth circuit 35 for controlling a sub-field.

Hereinbelow is explained a sub-field.

In the plasma display panel 1, a luminance of each of colors displayed in each of the cells is in proportion to the number of sustaining pulses, as mentioned earlier. Images are displayed in gray scales by changing the number of sustaining pulses in one frame period in which frames constituting one display screen are displayed. Hence, a frame is comprised of a plurality of sub-fields, and a binary image is displayed in each of sub-fields. Further, a period of time in which a light is emitted in each of the cells is weighed in each of sub-fields. Such a process as mentioned above is called a sub-field process.

For instance, if a frame is comprised of eight sub-fields, and a ratio in the number of sustaining pulses in each of sub-fields is determined as 1:2:4:8:16:32:64:128, an image can be displayed in 256 ($2^8$=256) gray scales.

The first circuit 32 receives an analog image signal Sp from an external circuit (not illustrated), and converts the received analog image signal Sp into digital image data. Then, the first circuit 32 applies reverse-gamma compensation to the digital image data, and transmits the resultant image data $D_{P1}$, to both the second circuit 33 and the fourth circuit 35.

Herein, reverse-gamma compensation indicates the following compensation. The image signal Sp transmitted from an external circuit has characteristics which have been gamma-compensated to match with gamma characteristics of a cathode ray tube (CRT) display. The reverse-gamma compensation is carried out in order to cause characteristics of the above-mentioned digital image data to match with linear gamma characteristics of the plasma display panel 1.

The second circuit 33 computes an average peak luminance level over a display screen per a frame, and transmits computation results CR to the third circuit 34.

The third circuit 34 produces the total number SS of sustaining pulses per a frame in association with the average peak luminance level, and data Ds indicative of the number of sustaining pulses in each of the sub-fields, based on the computation results CR transmitted from the second circuit 33.

The fourth circuit 35 produces digital image data Dp in accordance with which the plasma display panel 1 is driven, based on the image data $D_{P1}$, in accordance with the total number SS of sustaining pulses. The fourth circuit 35 then transmits the thus produced digital image data Dp to the drive controller 22 together with the data Ds indicative of the number of sustaining pulses in each of the sub-fields.

FIG. 5 is a timing chart of an operation of the above-mentioned driver circuit. Hereinbelow is explained an operation of the plasma display panel 1 with reference to FIG. 5.

FIG. 5 illustrates waveforms of signals in a certain sub-field SF of a frame. FIG. 5(A) shows an example of a scanning pulse Psck to be applied to the scanning electrode 3*k* wherein "k" is an integer equal to or greater than one (1), but equal to or smaller than N ($1 \leqq k \leqq N$), FIG. 5(B) shows an example of a sustaining pulse Psu to be applied to the sustaining electrodes $\mathbf{4}_1$ to $\mathbf{4}_N$, and FIG. 5(C) shows an example of a data pulse $P_{Dj}$ to be applied to the data electrode 10*j* wherein "j" is an integer equal to or greater than one (1), but equal to or smaller than M ($1 \leqq j \leqq M$).

A sub-field SF is comprised of a priming period Tp in which weak discharge is generated for reducing wall charges attracted to the scanning electrodes $\mathbf{3}_1$ to $\mathbf{3}_N$ and the sustaining electrodes $\mathbf{4}_1$ to $\mathbf{4}_N$ by priming period, an address period $T_A$ in which a cell in which an image is displayed is selected, a sustaining period Ts in which a light is emitted in the selected cell, and a charge-erasion period $T_E$ in which wall charges attracted to the scanning electrodes $\mathbf{3}_1$ to $\mathbf{3}_N$ and the sustaining electrodes $\mathbf{4}_1$ to $\mathbf{4}_N$ in the sustaining period Ts in the selected cell are erased.

The first circuit 32 receives an analog image signal Sp from an external circuit (not illustrated), and converts the received analog image signal Sp into digital image data. The first circuit 32 further applies reverse-gamma compensation to the digital image data, and transmits the resultant image data $D_{P1}$ to the second circuit 33 and the fourth circuit 35.

On receipt of the image data $D_{P1}$, the second circuit 33 computes an average peak luminance level over a display plane per a frame, and transmits the computation results CR to the third circuit 34. The third circuit 34 produces the total number SS of sustaining pulses per a frame in accordance with the average peak luminance level, and data Ds indicative of the number of sustaining pulses in each of the sub-fields, based on the computation results CR transmitted from the second circuit 33. The third circuit 34 produces the data Ds such that the number of sustaining pulses is increased for raising a luminance level over a display plane, if the average peak luminance level is relatively low, and the number of sustaining pulses is reduced for lowering a luminance level over a display plane, if the average peak luminance level is relatively high.

The fourth circuit 35 produces digital image data Dp in accordance with which the plasma display panel 1 is driven, based on the image data $D_{P1}$, in accordance with the total number SS of sustaining pulses. The fourth circuit 35 then transmits the thus produced digital image data Dp to the drive controller 22 together with the data Ds indicative of the number of sustaining pulses in each of the sub-fields.

The drive controller 22 produces a sustaining electrode driver control signal $S_{SU}$ for controlling the sustaining electrode driver 23, scanning electrode driver control signals $S_{SC1}$ to $S_{SC4}$ for controlling the scanning electrode driver 24, and a data driver control signal $S_{DD}$ for controlling the data driver 25, based on the digital image data Dp and the data Ds both received from the image processor 21.

As a result, in the priming period Tp, a serration-shaped and positive priming pulse $P_{PRP}$ illustrated in FIG. 5(A) is applied to the scanning electrodes $\mathbf{3}_1$ to $\mathbf{3}_N$, and a negative priming pulse $P_{PRN}$ illustrated in FIG. 5(B) is applied to the sustaining electrodes $\mathbf{4}_1$ to $\mathbf{4}_N$. Herein, a positive pulse means a pulse having a voltage higher than a sustaining voltage Vs, and a negative pulse means a pulse having a voltage smaller than the sustaining voltage Vs. Thus, priming discharge is generated in the discharge gas space 15 close to the discharge gap 5 formed between each of the scanning electrode $\mathbf{3}_1$ to $\mathbf{3}_N$ and each of the sustaining electrode $\mathbf{4}_1$ to $\mathbf{4}_N$. The priming discharge produces active particles which will assist in generation of sustaining discharge in a cell. In addition, negative wall charges are accumulated on the scanning electrodes $\mathbf{3}_1$ to $\mathbf{3}_N$, and positive wall charges are accumulated on the sustaining electrodes $\mathbf{4}_1$ to $\mathbf{4}_N$.

Then, as illustrated in FIG. 5(B), after voltages of the sustaining electrode $\mathbf{4}_1$ to $\mathbf{4}_N$ are sustained at the sustaining voltage Vs, a first charge-erasing pulse $P_{EEN1}$ which is negative and serration-shaped, illustrated in FIG. 5(A) is applied to the scanning electrode $\mathbf{3}_1$ to $\mathbf{3}_N$. As a result, weak discharge is generated in all of the cells, and accordingly, the negative wall charges attracted on the scanning electrode $\mathbf{3}_1$ to $\mathbf{3}_N$ and the positive wall charges attracted on the sustaining electrodes $\mathbf{4}_1$ to $\mathbf{4}_N$ are reduced.

In the address period $T_A$, a cell or cells in which a light is emitted is selected among the plurality of cells. All of the sustaining electrodes $\mathbf{4}_1$ to $\mathbf{4}_N$ are sustained at the sustaining voltage Vs, as illustrated in FIG. 5(B), and a negative standard pulse $P_{WBN}$ is applied to the scanning electrode $\mathbf{3}_1$ to $\mathbf{3}_N$ as a standard voltage, as illustrated in FIG. 5(A).

In such a condition as mentioned above, in order to select a cell or cells in each of columns, a negative scanning pulse $P_{WSN}$ illustrated in FIG, 5(A) is applied to the scanning electrode in a selected column. In addition, a positive data pulse $P_{DT}$ illustrated in FIG. 5(C) is applied to a data electrode in an associated row. For instance, the negative scanning pulse $P_{WSN}$ is applied to the scanning electrode 3*k*, and the positive data pulse $P_{DT}$ is applied to the data electrode 11*j*.

The data pulse $P_{DT}$ is a pulse for selecting a cell in which an image is to be displayed. In a cell located at an intersection of the scanning electrode 3*k* to which the negative scanning pulse $P_{WSN}$ was applied and the data electrode 11*j* to which the positive data pulse $P_{DT}$ was applied, there are generated facing discharge, and area discharge triggered by the facing discharge as selecting or writing discharge between the scanning electrode 3*k* and the sustaining electrode 4*k*.

In a cell in which the selecting or writing discharge was generated, positive wall charges are accumulated on the scanning electrodes $\mathbf{3}_1$ to $\mathbf{3}_N$, and negative wall charges are accumulated on the sustaining electrodes $\mathbf{4}_1$ to $\mathbf{4}_N$. In contrast, in a cell in which the selecting or writing discharge is no generated, only wall charges remaining after removal of wall charges by the negative first charge-erasing pulse $P_{EEN1}$ are accumulated on the scanning electrodes $\mathbf{3}_1$ to $\mathbf{3}_N$ and the sustaining electrodes $\mathbf{4}_1$ to $\mathbf{4}_N$. Hence, an amount of wall charges in a cell the selecting or writing discharge is no generated is quite smaller than an amount of wall charges in which the selecting or writing discharge was generated.

In the sustaining period Ts, a light is emitted in a selected cell. A negative sustaining pulse $P_{SUN2}$ illustrated in FIG. 5(B) is applied to all of the sustaining electrodes $\mathbf{4}_1$ to $\mathbf{4}_N$ a plurality of times, and at the same time, a negative sustaining pulse $P_{SUN1}$ illustrated in FIG. 5(A) is applied to the scanning electrodes $\mathbf{3}_1$ to $\mathbf{3}_N$ a plurality of times. Since wall charges are accumulated on the scanning electrodes $\mathbf{3}_1$ to $S_N$ and the sustaining electrodes $\mathbf{4}_1$ to $\mathbf{4}_N$ in a small amount in a cell which was not selected in the address period $T_A$, there is not generated sustaining charge caused by a combination of a voltage of the negative sustaining pulse $P_{SUN1}$ or $P_{SUN2}$ and a wall charge voltage, and hence, a cell does not emit a light.

In contrast, since positive wall charges are accumulated on the scanning electrodes $\mathbf{3}_1$ to $\mathbf{3}_N$ and negative wall charges are accumulated on the sustaining electrodes $\mathbf{4}_1$ to $\mathbf{4}_N$ in a cell having been selected in the address period $T_A$, a voltage of the negative sustaining pulse $P_{SUN1}$ or $P_{SUN2}$ and a wall charge voltage are combined to each other, and hence, a voltage between the scanning electrodes $\mathbf{3}_1$ to $\mathbf{3}_N$ and the sustaining electrodes $\mathbf{4}_1$ to $\mathbf{4}_N$ exceeds a critical voltage at which a discharge starts. As a result, there is generated sustaining discharge, and hence, a cell emits a light.

As is obvious in view of FIG. 5(A) and 5(B), a pulse width of the negative sustaining pulse $P_{SUN1}$ or $P_{SUN2}$ to be first applied to the scanning or sustaining electrodes is set wider than a pulse width of the following negative sustaining pulses $P_{SUN1}$ and $P_{SUN2}$. This is for the purpose that a cell having been selected in the address period TA can surely emit a light, as suggested in Japanese Patent No. 2674485 (Japanese Patent Application Publication No. 7-134565).

As a result of generation of sustaining discharge by the first applied negative sustaining pulses $P_{SUN1}$ and $P_{SUN2}$, wall charges are rearranged such that voltages applied to the scanning electrodes $\mathbf{3}_1$ to $\mathbf{3}_N$ and the sustaining electrodes $\mathbf{4}_1$ to $\mathbf{4}_N$ are cancelled. Accordingly, positive charges are accumulated on the sustaining electrodes $\mathbf{4}_1$ to $\mathbf{4}_N$, and negative charges are accumulated on the scanning electrodes $\mathbf{3}_1$ to $\mathbf{3}_N$. Since a negative sustaining pulse $P_{SUN1}$ is next applied to the scanning electrodes $\mathbf{3}_1$ to $\mathbf{3}_N$, an effective voltage to be applied to the discharge gas space 15 by combination of a voltage of wall charges and a voltage of the negative sustaining pulse $P_{SUN1}$ exceeds a critical voltage at which a discharge starts, resulting in that sustaining discharge is generated again.

Thereafter, the same steps as mentioned above are alternately repeated, and resultingly, sustaining discharge is repeatedly generated. A luminance in each of colors displayed in each of cells is defined by the number of repetition of the sustaining discharge.

In the charge-erasion period $T_E$, a negative and serration-shaped, second charge-erasion pulse $P_{EEN2}$ illustrated in FIG. 5(A) is applied to the scanning electrodes $\mathbf{3}_1$ to $\mathbf{3}_N$. Accordingly, there is generated weak discharge in all of the cells during a slope of the negative and serration-shaped, second charge-erasion pulse $P_{EEN2}$, resulting in that negative wall charges accumulated on the scanning electrodes $\mathbf{3}_1$ to $\mathbf{3}_N$ and positive wall charges accumulated on the sustaining electrodes $\mathbf{4}_1$ to $\mathbf{4}_N$ in a cell emitting a light in the sustaining period Ts, and hence, a charge condition in all of the cells in the plasma display panel 1 are uniformized.

In the above-mentioned conventional driver circuit for driving the plasma display panel 1, an image is displayed at a certain gray scale by changing the number of sustaining pulses in one frame period, and hence, it is not possible to display an image at a gray scale greater than the number of sustaining pulses.

As a method of reducing power consumption in a plasma display panel, there have been conventionally suggested a method (hereinafter, referred to as "first method") of reducing the number of sustaining pulses to be applied to the sustaining electrodes $\mathbf{4}_1$ to $\mathbf{4}_N$ in one frame period, and a method (hereinafter, referred to as "second method") of lowering the sustaining voltage Vs t thereby reduce a light intensity per one sustaining pulse.

However, the first method is accompanied with a problem that if the total number of sustaining pulses to be applied to the sustaining electrodes $\mathbf{4}_1$ to $\mathbf{4}_N$ in one frame period is smaller than 255, it would not be possible to display an image at 256 gray scales.

The second method is accompanied with a problem that if the conventional plasma display panel 1 operates in accordance with the second method, a luminance in each of cells varies in different degrees when the sustaining voltage Vs is reduced, resulting in that it would be quite difficult to display images at a uniform gray scale. The reason is as follows.

FIG. 6 is a graph showing an example of a relation between a luminance and a sustaining voltage in a cell in a conventional plasma display panel.

Some of conventional plasma display panels include cells each having a relation between a luminance and a sustaining voltage which relation is different from others, as shown with curves A and B in FIG. 6. This is caused by variance in fabrication of a plasma display panel, such as a thickness of the dielectric layer 9 formed on a lower surface of the front insulating substrate 2, or a discharge gap between the scanning electrodes $\mathbf{3}_1$ to $\mathbf{3}_N$ and the sustaining electrodes $\mathbf{4}_1$ to $\mathbf{4}_N$.

Hence, a difference in a luminance in cells was reduced in a conventional plasma display panel by selecting a sustaining voltage $V_{S1}$ close to a voltage at which a luminance is saturated. Accordingly, if the sustaining Vs is made smaller than the sustaining voltage $V_{S1}$ in accordance with the above-mentioned second method in order to reduce power consumption, a plasma display panel is operated with a sustaining voltage Vs involved in an area $V_{AR}$ (see FIG. 6) in which cells have different relations between a luminance and a sustaining voltage from one another. As a result, a luminance in the cells varies in different degrees, and hence, it would be quite difficult to display images at a uniform gray scale.

Furthermore, if the number of cells emitting a light in a plasma display panel, an impedance in the driver circuit would be changed accordingly, resulting in that a luminance in a cell is likely to be varied.

In order to solve the above-mentioned problems, Japanese Patent Application Publication No. 5-135701 has suggested a plasma display panel in which a cell is comprised of a sustaining electrode, and a plurality of scanning electrodes each spaced away form the sustaining electrode by a predetermined length. By selecting one or more of scanning electrodes among the scanning electrodes, an area in which sustaining discharged is generated is controlled for varying a display area, to thereby vary a luminance of a cell and power consumption.

However, the suggested plasma display panel is accompanied with the following problems.

First, it is necessary in the suggested plasma display panel to arrange scanning electrodes below a front insulating substrate in the number equal to or greater than the number of scanning lines, resulting in an increase in a size of a plasma display panel relative to the number of scanning lines.

Second, the suggested plasma display panel includes a plurality of scanning electrodes per a cell. It would be necessary in the suggested plasma display panel to arrange an opaque trace electrode under each of the scanning electrodes for shielding a light. This results in reduction in an aperture ratio. Consequently, a luminance is lowered, and hence, it would be quite difficult to accomplish a high luminance.

Third, it would be necessary for the suggested plasma display panel to include circuits for driving such a plurality of scanning electrodes, resulting in an increase in complexity and fabrication costs of the plasma display panel.

Japanese Patent Application Publication No. 2000-113827 has suggested a plasma display panel comprised of a first glass substrate, a first electrode formed on a surface of the first glass substrate, a second electrode formed on a surface of the first glass substrate such that the second electrode is spaced away from the first electrode by a predetermined distance, a dielectric layer formed on a surface of the first glass substrate so as to cover the first and second electrodes therewith, a second glass substrate facing the first glass substrate, a plurality of partition walls arranged between the first and second glass substrates so as to define a discharge space above the first and second electrodes, a phosphor layer formed on the second glass substrate so that the phosphor layer faces the discharge space, and a gas filled in the discharge space and producing ultra-violet lights for exciting the phosphor layer, characterized in that the dielectric layer has a thickness varying in association with portions of the first electrode, and further in association with portions of the second electrode.

Japanese Patent Application Publication No. 2000-156167 has suggested an alternating current (AC) memory operation type plasma display panel including electrodes facing each other with a discharge gap sandwiched therebetween, which electrodes are designed to have a plurality of small apertures.

Japanese Patent Application Publication No. 9-330665 has suggested an alternating current (AC) memory operation type plasma display panel including a pair of sustaining electrodes buried in a dielectric layer in a depth shallower towards a discharge gap from edges of the sustaining electrodes located opposite to the discharge gap.

Japanese Patent Application Publication No. 2000-294149 has suggested a plasma display unit comprised of a first substrate, a second substrate, a first dielectric layer formed on the first substrate, first and second electrodes both formed on the first substrate and covered with the dielectric layer, and producing plasma through the dielectric layer in a plurality of discharge cells, and a plurality of partition walls formed on the second substrate. Each of the first and second electrodes is comprised of an inner electrode located in the vicinity of a discharge gap, an outer electrode spaced away from the inner electrode, and a connector electrode for electrically connecting the inner and outer electrodes to each other. Orthogonal projection in an area in which the connector electrode does not overlap the partition walls, viewed from a direction which passes the first and second substrates is not continuous over both of the outer and inner electrodes.

Japanese Patent Application Publication No. 2000-195431 has suggested a plasma display panel including a grid-shaped partition wall arranged between front and rear substrates, and comprised of first portions extending in a row direction and second portions extending in a column direction, and a raised portion projecting towards the second portions to thereby eliminate a space between itself and the second portions.

Japanese Patent Application Publications Nos. 2000-267627 and 2000-214822 have suggested a method of driving a plasma display panel which method is capable of enhancing a contrast and reducing power consumption.

However, the above-mentioned problems remain unsolved even in the above-listed Japanese Patent Application Publications.

SUMMARY OF THE INVENTION

In view of the above-mentioned problems in the conventional plasma display panels, it is an object of the present invention to provide a plasma display panel which is capable of being fabricated in a smaller size, more readily and in smaller fabrication costs, displaying images at a gray scale equal to or greater than the number of sustaining pulses, and reducing power consumption with a high and uniform gray scale being maintained.

It is also an object of the present invention to provide a method of driving a plasma display panel which method is capable of doing the same.

It is further an object of the present invention to provide a circuit for driving a plasma display panel which circuit is capable of doing the same.

It is further an object of the present invention to provide a plasma display unit which is capable of doing the same.

In one aspect of the present invention, there is provided a plasma display panel including a plurality of cells arranged in a matrix, wherein each of the cells includes (a) a scanning electrode having partial cutout, (b) a sustaining electrode having partial cutout, spaced away from the scanning electrode by a discharge gap in mirror-symmetry with a centerline of the discharge gap extending in a first direction, (c) a first trace electrode extending in the first direction on the opposite side of the scanning electrode about the discharge gap such that the first trace electrode makes electrical contact with the scanning electrode and further with a scanning electrode of an adjacent cell, and (d) a second trace electrode extending in the first direction on the opposite side of the sustaining electrode about the discharge gap such that the second trace electrode makes electrical contact with the sustaining electrode and further with a sustaining electrode of an adjacent cell.

For instance, the partial cutout defines an area of the cell in which sustaining discharge is most intensive.

For instance, the scanning electrode may be comprised of a single first part facing the discharge gap and extending in the first direction, and two second parts extending in a second direction perpendicular to the first direction, and spaced away from each other in parallel, wherein the first part is connected at its opposite ends to the second parts, and each of the second parts makes electrical contact with the first trace electrode.

For instance, each of the second parts makes electrical contact at distal ends thereof with the first trace electrode.

For instance, the sustaining electrode may be comprised of a single first part facing the discharge gap and extending in the first direction, and two second parts extending in a second direction perpendicular to the first direction, and spaced away from each other in parallel, wherein the first part is connected at its opposite ends to the second parts, and each of the second parts makes electrical contact with the second trace electrode.

For instance, each of the second parts makes electrical contact at distal ends thereof with the second trace electrode.

For instance, the scanning electrode may be comprised of a plurality of first parts extending in the first direction, and two second parts extending in a second direction perpendicular to the first direction, and spaced away from each other in parallel, wherein the first part is connected at its opposite ends to the second parts, one of the first parts faces the discharge gap, and the rest of the first parts are spaced away from one another at the opposite side of the one of the first parts about the discharge gap, and each of the second parts makes electrical contact with the first trace electrode.

For instance, the first parts may be equal in width to one another.

For instance, the first parts may be equally spaced away from one another.

For instance, one of the first parts is located on the first trace electrode in electrical contact.

For instance, the sustaining electrode is comprised of a plurality of first parts extending in the first direction, and two second parts extending in a second direction perpendicular to the first direction; and spaced away from each other in parallel, wherein each of the first parts is connected at its opposite ends to the second parts, one of the first parts faces the discharge gap, and the rest of the first parts are spaced away from one another at the opposite side of the one of the first parts about the discharge gap, and each of the second parts makes electrical contact with the second trace electrode.

For instance, the scanning electrode, the sustaining electrode, and the first and second trace electrodes are formed on an electrically insulating substrate, and the plasma display panel may further include a dielectric layer formed on the electrically insulating substrate, covering the scanning electrode, the sustaining electrode, and the first and second trace electrodes therewith, the dielectric layer being comprised of a first portion covering therewith an area including the discharge gap, and a second portion other than the first portion, the first portion having a thickness smaller than a thickness of the second portion.

For instance, the scanning electrode, the sustaining electrode, and the first and second trace electrodes are formed on an electrically insulating substrate, and the plasma display panel may further include a dielectric layer formed on the electrically insulating substrate, covering the scanning electrode, the sustaining electrode, and the first and second trace electrodes therewith, the dielectric layer being comprised of a first portion covering therewith an area including the discharge gap, and a second portion other than the first portion, the first portion having a dielectric constant higher than the same of the second portion.

For instance, each of the scanning and sustaining electrodes is comprised of a electrically conductive transparent thin film, and each of the first and second trace electrodes is comprised of a metal film.

There is further provided a plasma display panel including a plurality of cells arranged in a matrix, wherein each of the cells includes (a) a first scanning electrode extending in a first direction, (b) a first sustaining electrode spaced away from the first scanning electrode by a discharge gap, and extending in the first direction, (c) at least one second scanning electrode spaced away from the first scanning electrode at the opposite side of the first scanning electrode about the discharge gap, (d) at least one second sustaining electrode spaced away from the first sustaining electrode at the opposite side of the first sustaining electrode about the discharge gap, (e) a first trace electrode comprised of a single first part extending in the first direction, and two second parts extending in a second direction perpendicular to the first direction above partition walls extending in the direction for partitioning the cells, the first part and second parts being connected to each other above the partition walls, the first part being spaced away from a second scanning electrode remotest from the discharge gap among the at least one second scanning electrode, the first and second scanning electrodes making electrical contact with the second parts above the partition walls, and (f) a second trace electrode comprised of a single first part extending in the first direction, and two second parts extending in the second direction above the partition walls, the first part and second parts being connected to each other above the partition walls, the first part being spaced away from a second sustaining electrode remotest from the discharge gap among the at least one second sustaining electrode, the first and second sustaining electrodes making electrical contact with the second parts above the partition walls.

For instance, the plasma display panel may include a plurality of second scanning electrodes which are equal in width to one another.

For instance, the plasma display panel may include a plurality of second sustaining electrodes which are equal in width to one another.

For instance, each of the first and second scanning electrodes and each of the first and second sustaining electrodes may be comprised of a electrically conductive transparent thin film, and each of the first and second trace electrodes may be comprised of a metal film.

In another aspect of the present invention, there is provided a method of driving a plasma display panel defined above, including the step of changing the number of sustaining pulses to be applied to the scanning and sustaining electrodes in a sustaining period in at least one sub-field among a plurality of sub-fields constituting a frame, for displaying images in a gray scale, wherein a curve indicating a relation between a luminance and a sustaining voltage in the cell includes at least one intermediate region in which a luminance remains almost unchanged even if the sustaining voltage is increased, and the sustaining pulses have an amplitude equal to the sustaining voltage.

There is further provided a method of driving a plasma display panel defined above, including the step of changing the number of sustaining pulses to be applied to the scanning and sustaining electrodes in a sustaining period in at least one sub-field among a plurality of sub-fields constituting a frame, for displaying images in a gray scale, wherein a curve indicating a relation between a luminance and a sustaining voltage in the cell includes at least one intermediate region in which a luminance remains almost unchanged even if the sustaining voltage is increased, and one of the sustaining pulses has an amplitude equal to the sustaining voltage.

In still another aspect of the present invention, there is provided a circuit for driving a plasma display panel defined above by changing the number of sustaining-pulses to be applied to the scanning and sustaining electrodes in a sustaining period in at least one sub-field among a plurality of sub-fields constituting a frame, for displaying images in a gray scale, the circuit including (a) a first circuit for operating an average luminance level of image data per a frame, (b) a second circuit for transmitting, based on the results of operation having been carried out by the first circuit, data indicative the total number of sustaining pulses in the frame in accordance with the average luminance level, and data indicative of the number of sustaining pulses for each of sub-fields which number determines a luminance in each of the cells, (c) a third circuit for selecting, based on the results and the total number of sustaining pulses, one of an amplitude of a first sustaining voltage close to a voltage at which a luminance is saturated, and an amplitude of a certain period of second sustaining amplitude in which a luminance remains almost unchanged even if the sustaining voltage is increased, as an amplitude of a sustaining voltage in each of the sub-fields, and for transmitting an amplitude selection signal indicative of the thus selected amplitude, and (d) a fourth circuit for producing image data by which the plasma display panel is driven, based on the image data, in accordance with the amplitude selection signal, wherein an amplitude of the second sustaining voltage is selected as an amplitude of a sustaining pulse to be applied to the scanning and sustaining electrodes in a sustaining period in at least one sub-field among the plurality of sub-fields.

There is further provided a circuit for driving a plasma display panel defined in claim 1 by changing the number of sustaining pulses to be applied to the scanning and sustaining electrodes in a sustaining period in at least one sub-field among a plurality of sub-fields constituting a frame, for displaying images in a gray scale, the circuit including (a) a first circuit for operating an average luminance level of image data per a frame, (b) a second circuit for transmitting, based on the results of operation having been carried out by the first circuit, data indicative the total number of sustaining pulses in the frame in accordance with the average luminance level, and data indicative of the number of sustaining pulses for each of sub-fields which number determines a luminance in each of the cells, (e) a third circuit for selecting, based on the results and the total number of sustaining pulses, one of an amplitude of a first sustaining voltage dose to a voltage at which a luminance is saturated, and an amplitude of a certain period of second sustaining amplitude in which a luminance remains almost unchanged even if the sustaining voltage is increased, as an amplitude of a sustaining voltage in each of the sub-fields, and for transmitting an amplitude selection signal indicative of the thus selected amplitude, and (d) a fourth circuit for producing image data by which the plasma display panel is driven, based on the image data, in accordance with the amplitude selection signal, wherein an amplitude of the second sustaining voltage is selected as an amplitude of one of sustaining pulses to be applied to the scanning and sustaining electrodes in a sustaining period in at least one sub-field among the plurality of sub fields.

In yet another aspect of the present invention, there is provided a plasma display unit including a plasma display panel defined above, and a circuit for driving the plasma display panel, defined above.

The advantages obtained by the aforementioned present invention will be described hereinbelow.

In a plasma display panel in accordance with the present invention, a scanning electrode is designed to have partial cutout, and a sustaining electrode is designed to have partial cutout. A first trace electrode makes electrical contact with the scanning electrode, and a second trace electrode makes electrical contact with the sustaining electrode. A curve indicating a relation between a luminance and a sustaining voltage in a cell includes at least one intermediate region in which a luminance remains almost unchanged even if the sustaining voltage is increased. The sustaining pulses are designed to have an amplitude equal to the sustaining voltage. These structures make it possible to fabricate a plasma display panel in a smaller size, more readily and in smaller fabrication costs, display images at a gray scale equal to or greater than the number of sustaining pulses, and reduce power consumption with a high and uniform gray scale being maintained.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

[First Embodiment]

Figure 7:
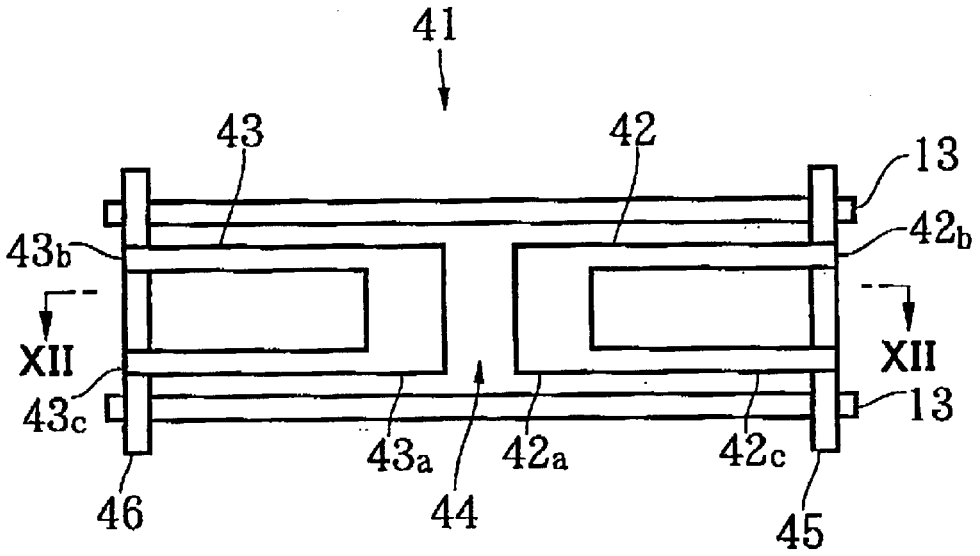
FIG. 7 is an upper view of a cell in the plasma display panel in accordance with the first embodiment of the present invention, with a front insulating substrate being removed.

FIG. 7 is an upper view of a cell in an alternating current (AC) memory operation type plasma display panel 41 in accordance with the first embodiment of the present invention, with a front insulating substrate being removed.

In the cell illustrated in FIG. 7, a scanning electrode 42 and a sustaining electrode 43 are arranged on a lower surface of a front insulating substrate (not illustrated). The scanning electrode 42 and the sustaining electrode 43 are spaced away from each other by a discharge gap 44. Each of the scanning electrode 42 and the sustaining electrode 43 is comprised of an electrically conductive transparent thin film composed, for instance, of tin oxide, indium oxide or indium tin oxide (ITO).

The scanning electrode 42 is comprised of a first part 42*a* extending in a column direction (an up-down direction in FIG. 7), and two second parts 42*b* and 42*c* extending in parallel in a row direction (a left-right direction in FIG. 7). The first part 42*a* is connected at its opposite ends to the second parts 42*b* and 42*c*.

The sustaining electrode 43 is comprised of a first part 43*a* extending in the column direction, and two second parts 43*b* and 43*c* extending in parallel in the row direction. The first part 43*a* is connected at its opposite ends to the second parts 43*b* and 43*c*.

The scanning electrode 42 and the sustaining electrode 43 are equal or similar in size to each other. The scanning electrode 42 and the sustaining electrode 43 are located in mirror-symmetry with each other about an imaginary centerline of the discharge gap 44 extending in the column direction.

A first trace electrode 45 in the form of a stripe extends in the column direction just below lower surfaces of the second parts 42*b* and 42*c* of the scanning electrode 42 at their distal ends. The first trace electrode 45 makes electrical contact with the second parts 42*b* and 42*c* of the scanning electrode 42 at their distal ends.

A second trace electrode 46 in the form of a stripe extends in the column direction just below lower surfaces of the second parts 43*b* and 43*c* of the sustaining electrode 43 at their distal ends. The second trace electrode 46 makes electrical contact with the second parts 43*b* and 43*c* of the sustaining electrode 43 at their distal ends.

The first and second trace electrodes 45 and 46 are comprised of a metal film such as a thick silver film or a thin aluminum or copper film. The first and second trace electrodes 45 and 46 reduce electrical resistance between the scanning and sustaining electrodes 42 and 43 both having a low electrical conductivity, and a later mentioned driver circuit electrically connected to the scanning and sustaining electrodes 42 and 43.

The scanning electrode 42 makes electrical contact with a scanning electrode located adjacent in the column direction, through the first trace electrode 45, and the sustaining electrode 43 makes electrical contact with a sustaining electrode located adjacent in the column direction, through the second trace electrode 46.

Figure 1:
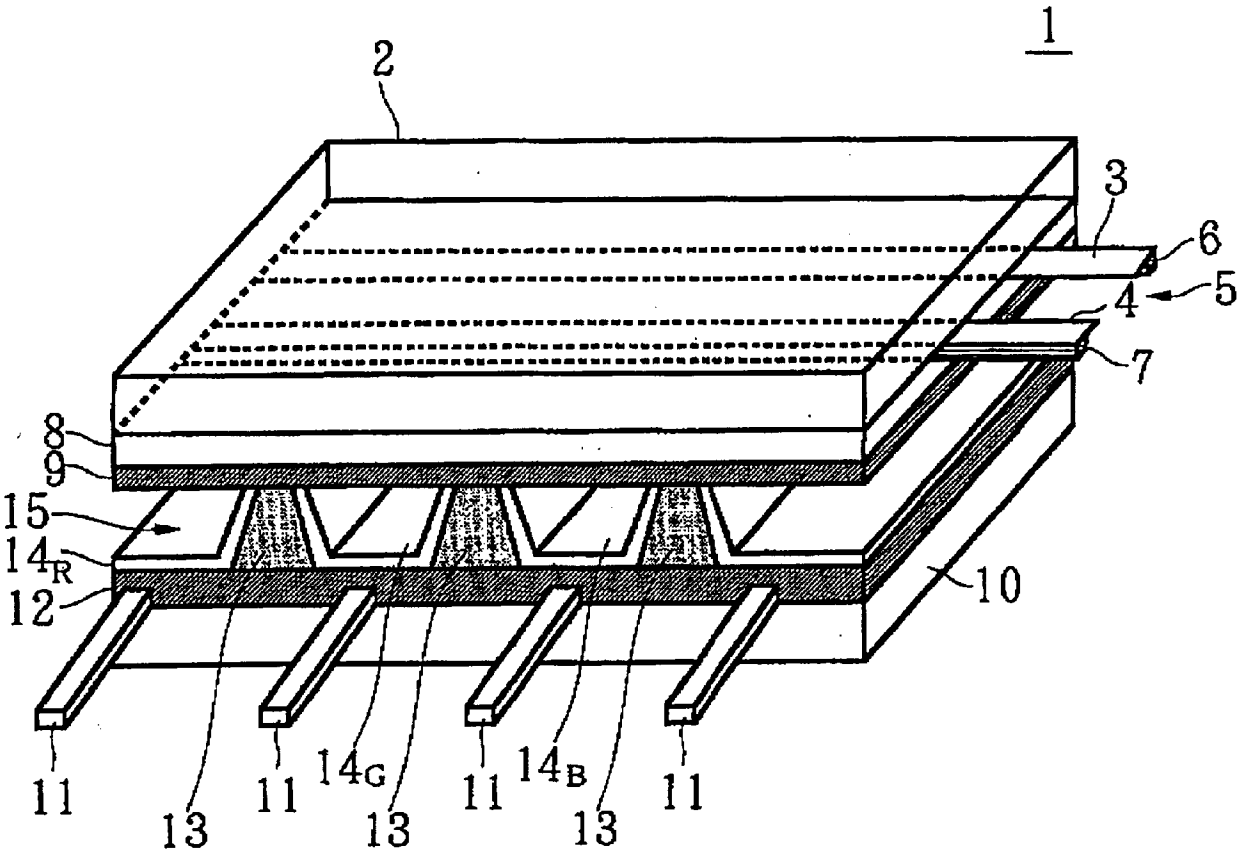
FIG.1 PRIOR ART
FIG. 1 is a partial perspective view of a structure of a conventional alternating current (AC) memory operation type plasma display panel.

Though not illustrated, the plasma display panel 41 in accordance with the first embodiment is designed to include a dielectric layer and a protection layer, similarly to the plasma display panel illustrated in FIG. 1. Furthermore, the plasma display panel 41 is designed to include a rear insulating substrate, data electrodes, a dielectric layer, partition walls, three phosphor layers, and discharge gas filled in a discharge gas space all of which are similar to those illustrated in FIG. 1. FIG. 7 illustrates only the partition walls 13 among them.

Figure 8:
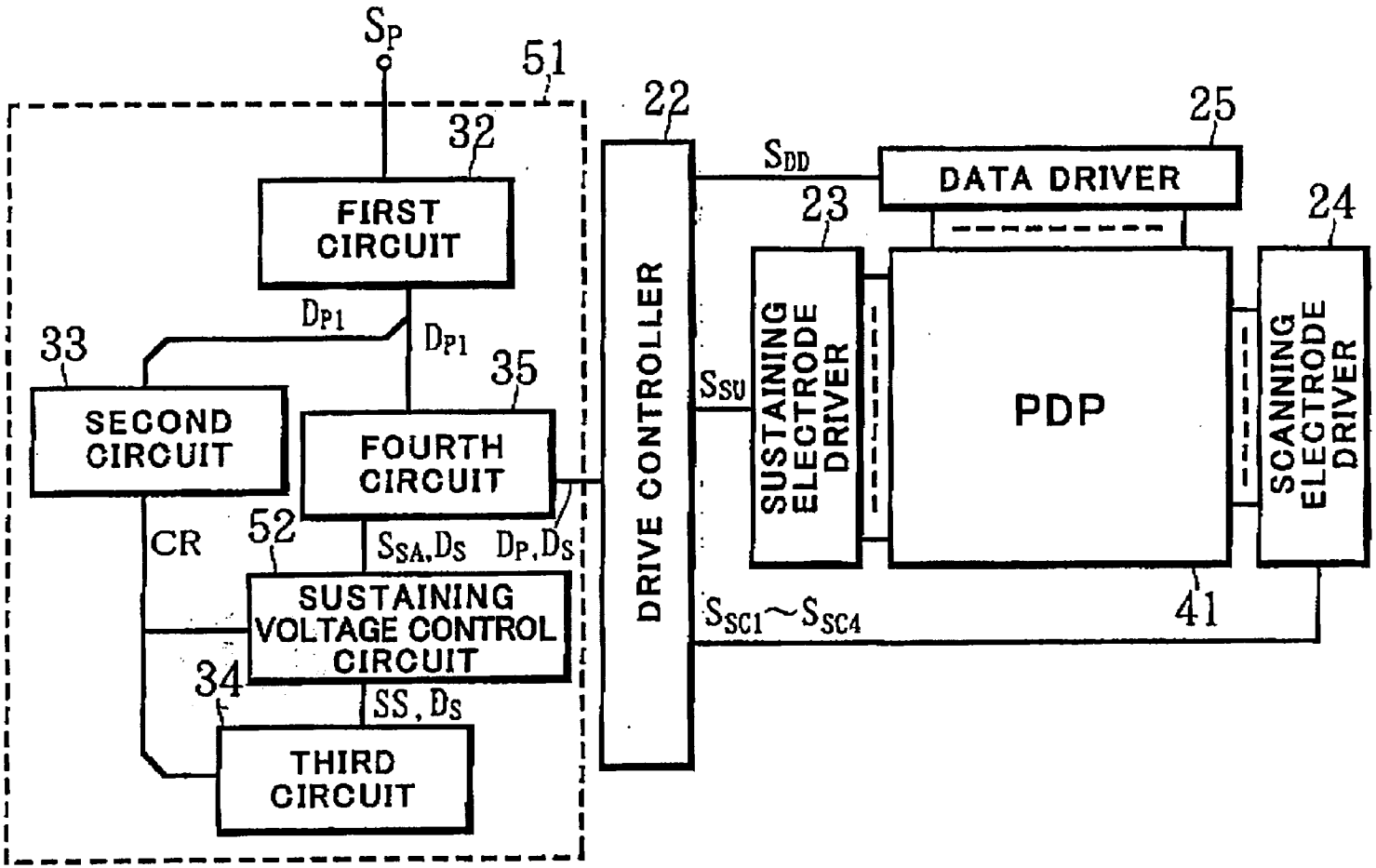
FIG. 8 is a block diagram of a driver circuit for driving the plasma display panel in accordance with the first embodiment of the present invention.

FIG. 8 is a block diagram of a driver circuit for driving the above-mentioned plasma display panel 41 in accordance with the first embodiment. Parts or elements that correspond to those of the driver circuit illustrated in FIG. 3 have been provided with the same reference numerals, and operate in the same manner as corresponding parts or elements illustrated in FIG. 3, unless explicitly explained hereinbelow.

Figure 3:
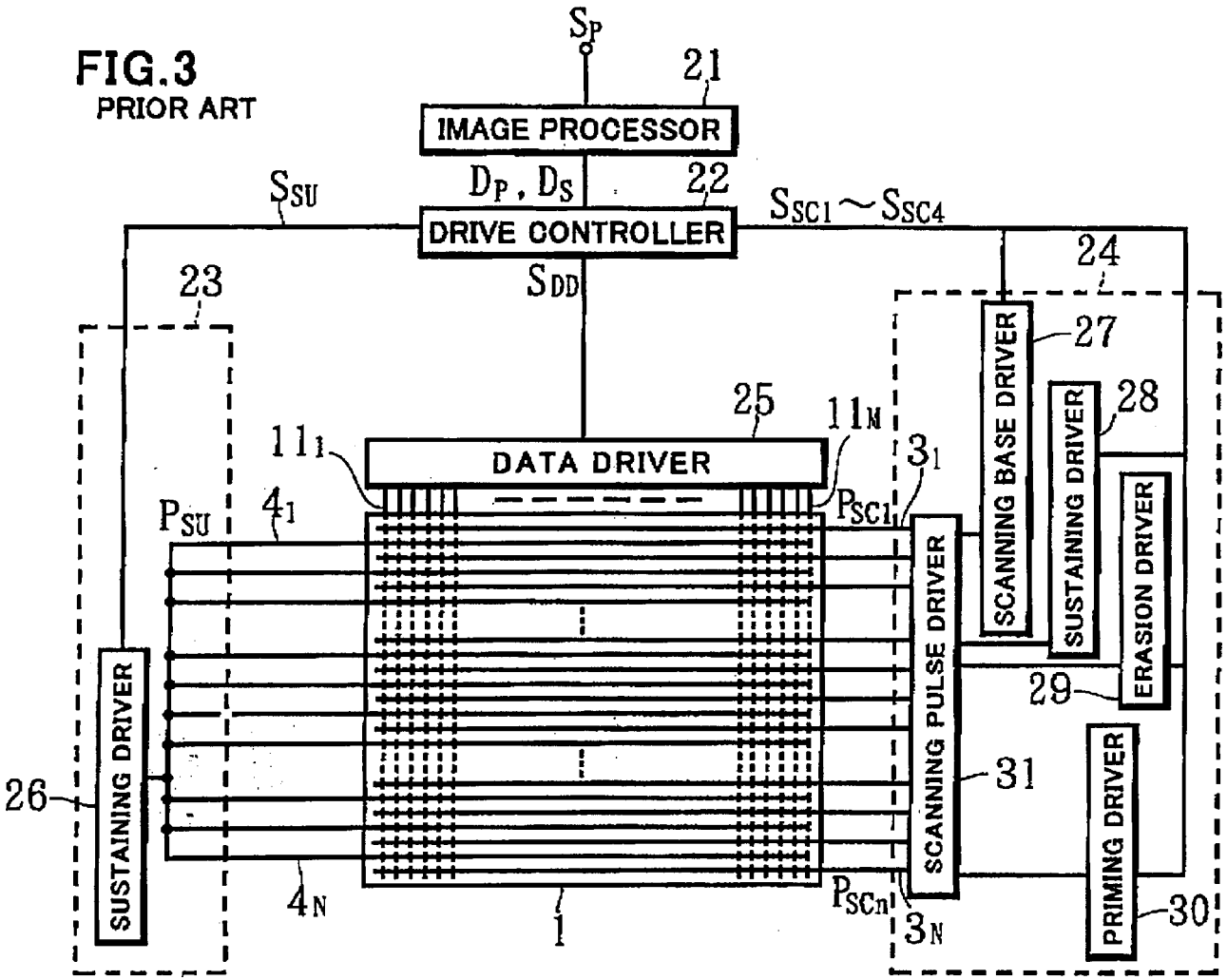
FIG.3 PRIOR ART
FIG. 3 is a block diagram of the plasma display panel illustrated in FIG. 1, and a conventional driver circuit for driving the plasma display panel.
Figure 4:
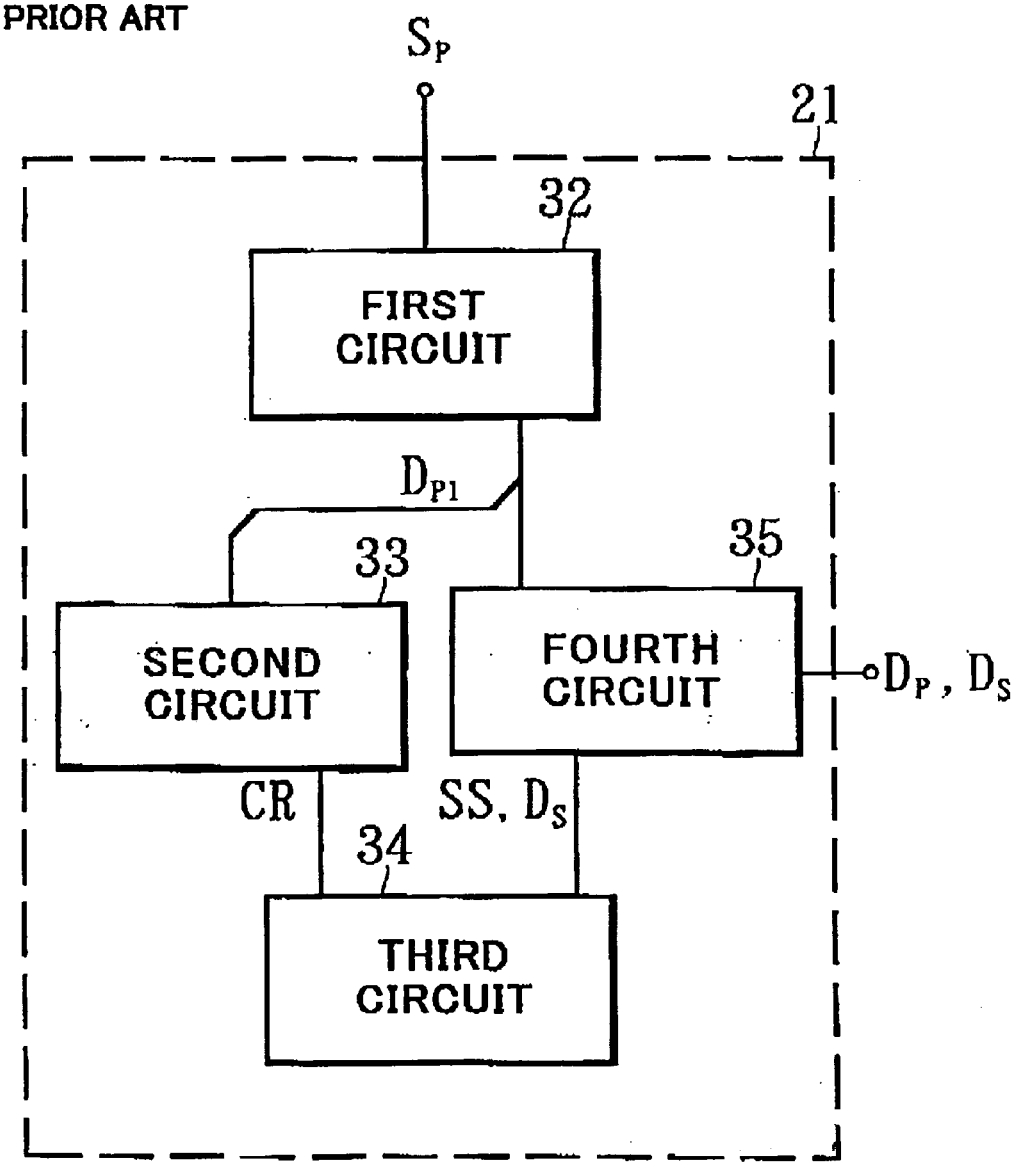
FIG.4 PRIOR ART
FIG. 4 is a block diagram of an image processor which is a part of the driver circuit illustrated in FIG. 3.

The driver circuit illustrated in FIG. 8 is designed to include an image processor 51 in place of the image processor 21 illustrated in FIGS. 3 and 4.

The image processor 51 receives an analog image signal Sp transmitted from an external circuit (not illustrated), and applies analog-digital conversion to the received analog image signal Sp to thereby produce digital image data Dp for driving the plasma display panel 41. The image processor 51 further produces data Ds indicative of the number of sustaining pulses which number determines a luminance of each of colors displayed in each of the cells in the plasma display panel 41. The image processor 51 operates in accordance with PLE process, similarly to the image processor 21 illustrated in FIG. 4.

In the image processor 51 illustrated in FIG. 8, parts or elements that correspond to those of the image driver 21 illustrated in FIG. 4 have been provided with the same reference numerals, and operate in the same manner as corresponding parts or elements illustrated in FIG. 4, unless explicitly explained hereinbelow.

The image processor 51 illustrated in FIG. 8 is designed to additionally include a sustaining voltage control circuit 52 arranged between the third circuit 34 and the fourth circuit 35, in comparison with the image processor 21 illustrated in FIG. 4. The sustaining voltage control circuit 62 receives the computation results CR from the second circuit 33, and further receives the total number SS of sustaining pulses and data Ds indicative of the number of sustaining pulses in each of sub-fields, from the third circuit 34. The sustaining voltage control circuit 52 determines an amplitude of a sustaining voltage for each of sub-fields among two amplitudes, based on the received computation results CR and the total number SS of sustaining pulses. Then, the sustaining voltage control circuit 52 transmits an amplitude selection signal $S_{SA}$ indicative of the thus determined amplitude, and the data Ds to the fourth circuit 35.

On receipt of the amplitude selection signal $S_{SA}$, the fourth circuit 35 produces digital image data Dp for each of sub-fields for driving the plasma display panel 41, based on the image data $D_{P1}$, in accordance with the received amplitude selection signal $S_{SA}$, and transmits the thus produced image data Dp to the drive controller 22 together with the data Ds indicative of the number of sustaining pulses in each of sub-fields.

The plasma display panel 41, the image processor 51, the drive controller 22, the sustaining electrode driver 23, the scanning electrode driver 24, the data driver 25, and a power source (not illustrated) which produces voltages, and supplies the voltages to them are fabricated in a module.

Figure 9:
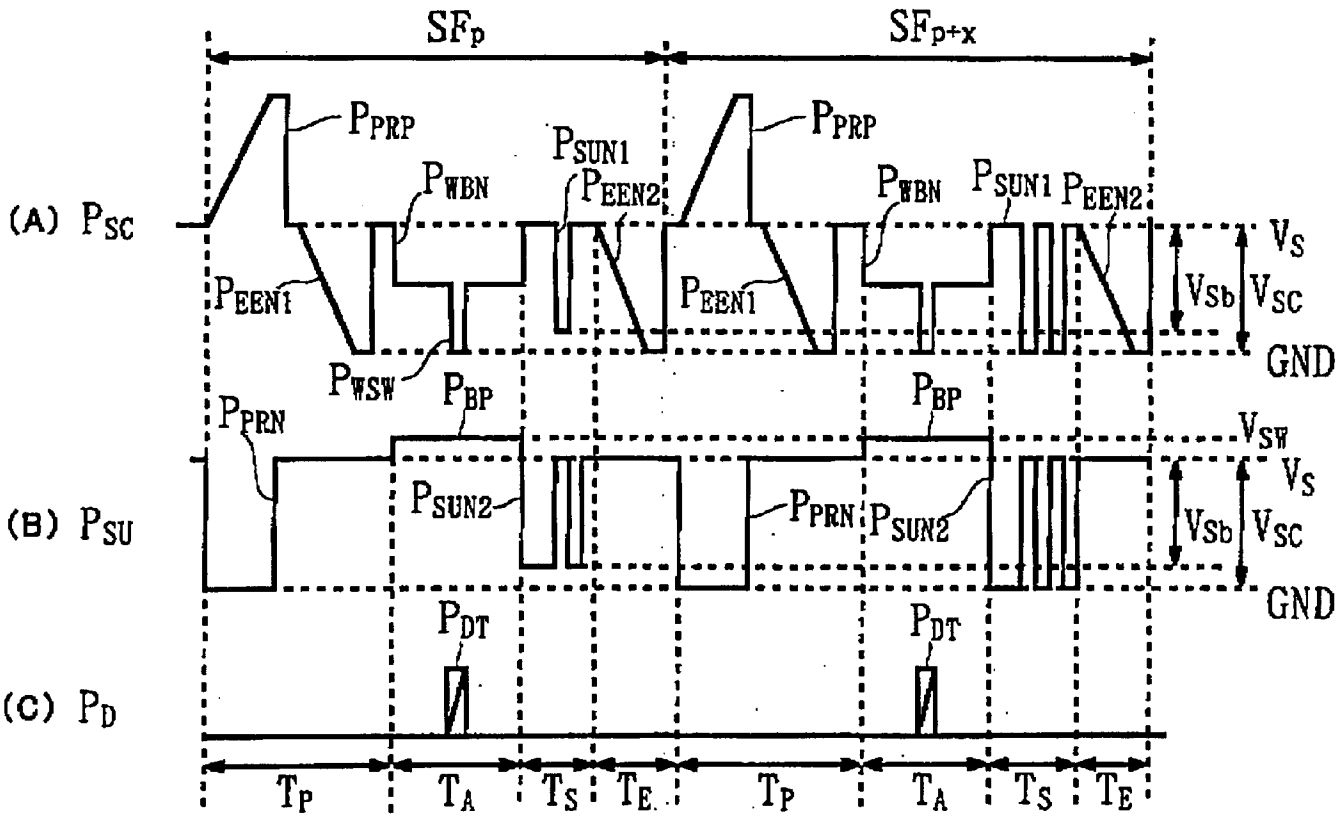
FIG. 9 is a timing chart of an operation of the driver circuit for driving the plasma display panel in accordance with the first embodiment of the present invention.

FIG. 9 is a timing chart of the plasma display panel 41, illustrating waveforms of signals in both a certain sub-field SFp and another sub-field SF(p+x) in a frame, wherein "p" and "x" are integers. Hereinbelow is explained an operation of the driver circuit with reference to FIG. 9.

FIG. 9(A) illustrates an example of a waveform of a scanning pulse Psc to be applied to the scanning electrode 42, FIG. 9(B) illustrates an example of a waveform of a sustaining pulse Psu to be applied to the sustaining electrode 43, and FIG. 9(C) illustrates an example of a waveform of a data pulse $P_D$ to be applied to the data electrode. In FIG. 9, for the purpose of explanation, waveforms of signals in a sub-field SFp and waveforms of signals in a sub-field SF(p+x) are illustrated adjacent to each other (that is, x=1).

Figure 5:
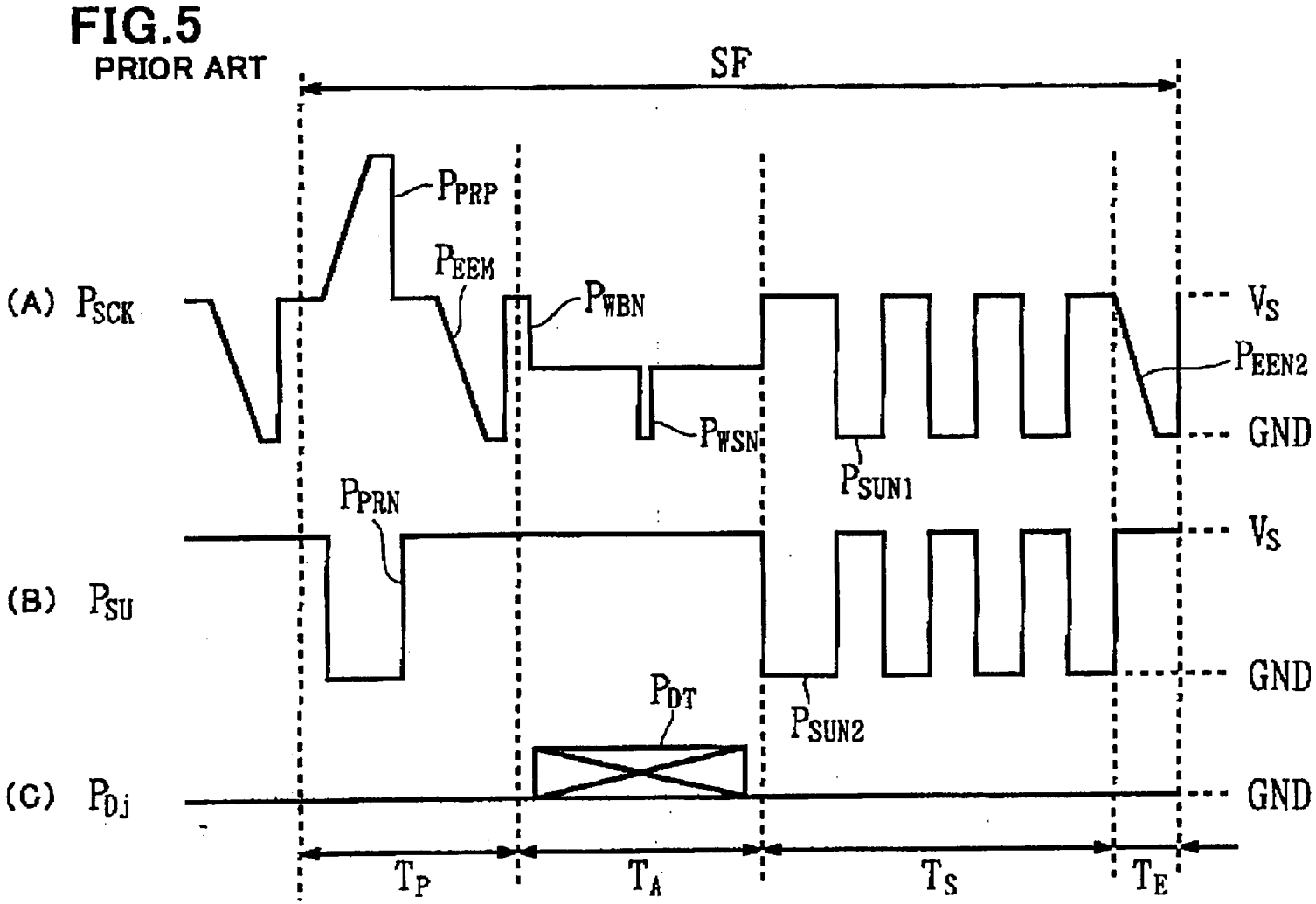
FIG.5 PRIOR ART
FIG. 5 is a timing chart of an operation of the driver circuit illustrated in FIG. 3.
Figure 6:
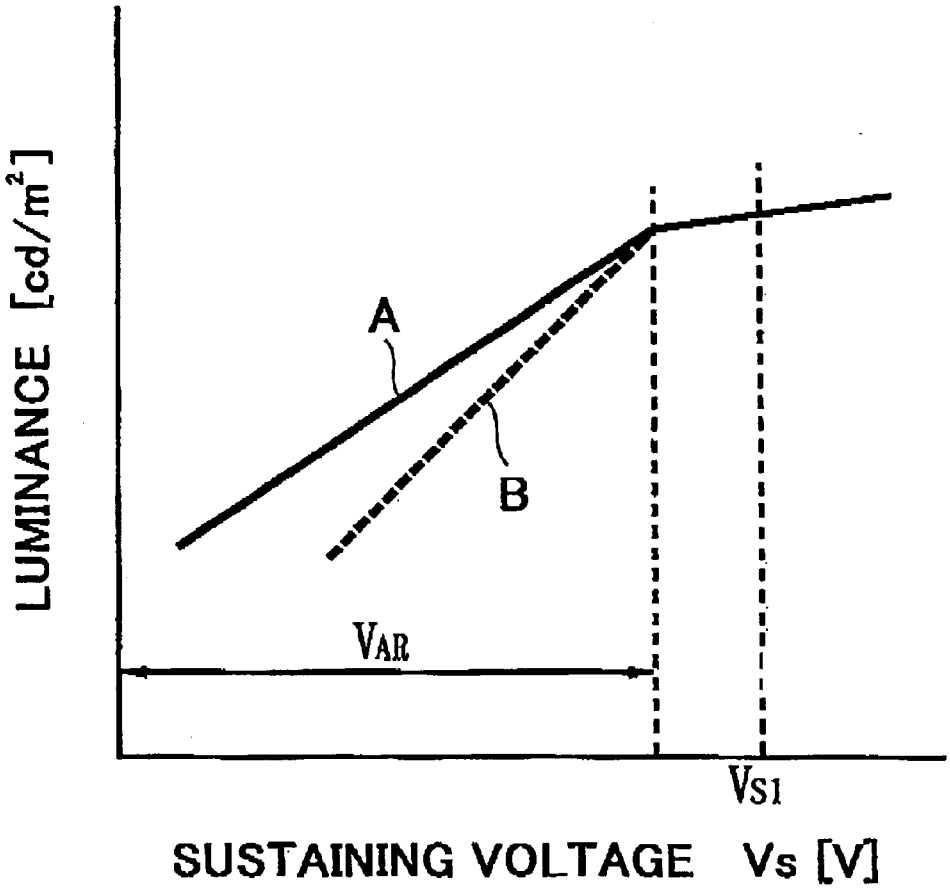
FIG.6 PRIOR ART
FIG. 6 is a graph showing an example of a relation between a luminance and a sustaining voltage in a cell in a conventional plasma display panel.

The waveforms of signals illustrated in FIG. 9 are almost the same as those illustrated in FIG. 5. Specifically, each of sub-fields is comprised of a priming period Tp, an address period $T_A$, a sustaining period Ts, and an erasion period $T_E$. However, the timing chart illustrated in FIG. 9 is different from the timing chart illustrated in FIG. 5 in that an amplitude of a sustaining voltage in a sub-field SFp is equal to a sustaining voltage Vssb smaller than an amplitude of a sustaining voltage Vsc in another sub-field SF(p+x).

The first circuit 32 in the image processor 51 receives an analog image signal Sp from an external circuit (not illustrated), and converts the received analog image signal Sp into digital image data. Then, the first circuit 32 applies reverse-gamma compensation to the digital image data, and transmits the resultant image data $D_{P1}$ to both the second circuit 33 and the fourth circuit 35.

On receipt of the image data $D_{P1}$, the second circuit 33 computes an average peak luminance APL) level over a display screen per a frame, and transmits computation results CR to the third circuit 34.

The third circuit 34 produces the total number SS of sustaining pulses per a frame in association with the average peak luminance (APL) level, and data Ds indicative of the number of sustaining pulses in each of sub-fields SF, based on the computation results CR transmitted from the second circuit 33.

The third circuit 34 produces the data Ds such that the number of sustaining pulses is increased for raising a luminance level over a display plane, if the average peak luminance (APL) level is relatively low, and the number of sustaining pulses is reduced for lowering a luminance level over a display plane, if the average peak luminance (APL) level is relatively high.

The sustaining voltage control circuit 52 receives the computation results CR from the second circuit 33, and further receives the total number SS of sustaining pulses and data Ds indicative of the number of sustaining pulses in each of sub-fields, from the third circuit 34. The sustaining voltage control circuit 52 determines an amplitude of a sustaining voltage for each of sub-fields among two amplitudes Vsb and Vsc of a sustaining voltage, based on the received computation results CR and the total number SS of sustaining pulses. Then, the sustaining voltage control circuit 52 transmits an amplitude selection signal $S_{SA}$ indicative of the thus determined amplitude, and the data Ds to the fourth circuit 35.

The fourth circuit 85 produces digital image data Dp for each of sub-fields in accordance with which the plasma display panel 41 is driven, based on the image data $D_{P1}$, in accordance with the amplitude selection signal $S_{SA}$. The fourth circuit 35 then transmits the thus produced digital image data Dp to the drive controller 22 together with the data Ds indicative of the number of sustaining pulses in each of sub-fields.

The drive controller 22 produces a sustaining electrode driver control signal $S_{SU}$ for controlling the sustaining electrode driver 23, scanning electrode driver control signals $S_{SC1}$ to $S_{SC4}$ for controlling the scanning electrode driver 24, and a data driver control signal $S_{DD}$ for controlling the data driver 25, based on the digital image data Dp and the data Ds both received from the image processor 51.

Herein is explained an operation of the plasma display panel 41 with reference to FIG. 9.

An-operation of the plasma display panel 41 in the priming period Tp and the charge-erasion period $T_E$ is identical with the same in the conventional plasma display panel 1, and hence, is not explained.

In the address period $T_A$, a cell or cells in which a light is emitted is selected among a plurality of cells. As illustrated in FIG. 9(B), a positive bias pulse $P_{BP}$ determined in accordance with a bias voltage $V_{SW}$ is applied to all of the sustaining electrodes, and, as illustrated in FIG. 9(A), a negative standard pulse $P_{WBN}$ as a standard voltage is applied to all of the scanning electrodes.

In such a condition as mentioned above, in order to select a cell or cells in each of columns, a negative scanning pulse $P_{SWN}$ illustrated in FIG. 9(A) is applied to the scanning electrodes in a selected column. In addition, a positive data pulse $P_{DT}$ illustrated in FIG. 9(C) is applied to data electrodes in an associated row.

The data pulse $P_{DT}$ is a pulse for selecting a cell in which an image is to be displayed. In a cell located at an intersection of the scanning electrode to which the negative scanning pulse $P_{WSN}$ was applied and the data electrode to which the positive data pulse $P_{DT}$ was applied, there are generated facing discharge, and area discharge triggered by the facing discharge as selecting or writing discharge between the scanning electrode and the sustaining electrode.

In a cell in which the selecting or writing discharge was generated, positive wall charges are accumulated on the scanning electrodes, and negative wall charges are accumulated on the sustaining electrodes. In contrast, in a cell in which the selecting or writing discharge is no generated, only wall charges remaining after removal of wall charges by the negative first charge-erasing pulse $P_{EEN1}$ are accumulated on the scanning electrodes and the sustaining electrodes. Hence, an amount of wall charges in a cell the selecting or writing discharge is no generated is quite smaller than an amount of wall charges in which the selecting or writing discharge was generated.

Hereinbelow is explained an operation of the plasma display panel 41 in the sustaining period Ts.

Figure 10:
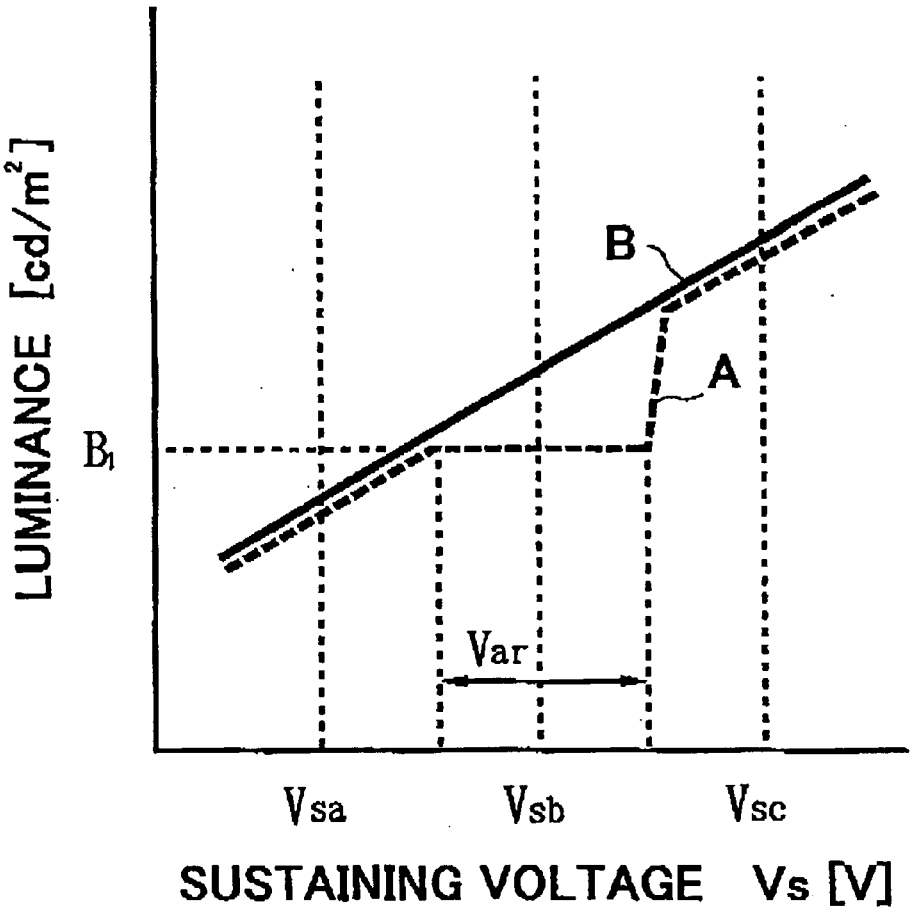
FIG. 10 is a graph showing a relation between a luminance and a sustaining voltage in both a cell in the plasma display panel in accordance with the first embodiment of the present invention and a cell in a conventional plasma display panel.

FIG. 10 is a graph showing a relation between a luminance and a sustaining voltage in both a cell in the plasma display panel 41 and a cell in the conventional plasma display panel 1. In FIG. 10, a curve A indicates a relation between a luminance and a sustaining voltage in a cell in the plasma display panel 41, that is, a cell having the structure illustrated in FIG. 7, and a line B indicates a relation between a luminance and a sustaining voltage in a cell in the conventional plasma display panel 1, that is, a cell having the structure illustrated in FIG. 2.

As is understood in view of FIG. 10, in the relation in a cell in the conventional plasma display panel 1, a luminance becomes higher proportionally, as a sustaining voltage Vs becomes higher within the sustaining voltage Vs illustrated in FIG. 10 (see the line B).

In contrast, the relation in a cell in the plasma display panel 41 includes an intermediate area Var of a sustaining voltage Vs in which a luminance remains equal to a luminance B1 without a change, even if a sustaining voltage Vs is increased, as shown in the curve A.

Figure 2:
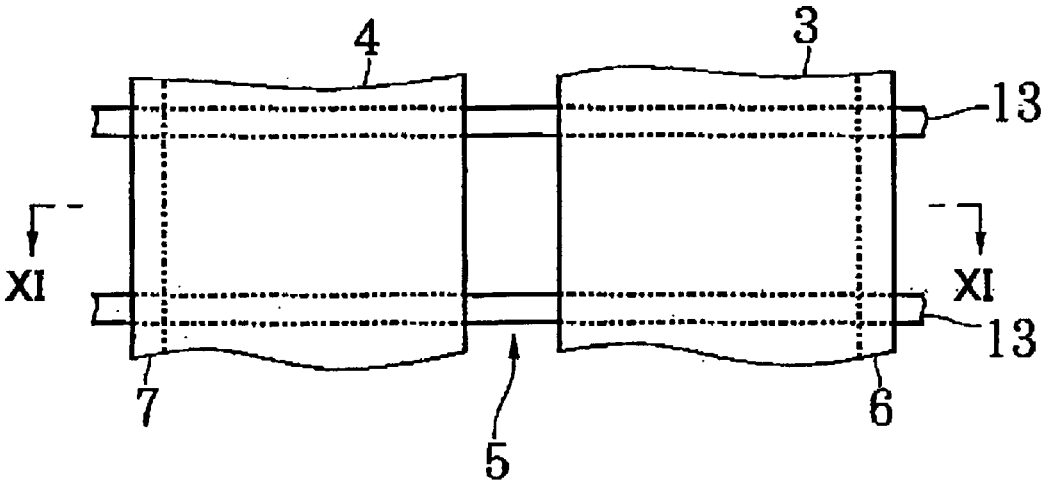
FIG.2 PRIOR ART
FIG. 2 is an upper view of a cell in the plasma display panel illustrated in FIG. 1 with a front insulating substrate being removed.
Figure 11A:
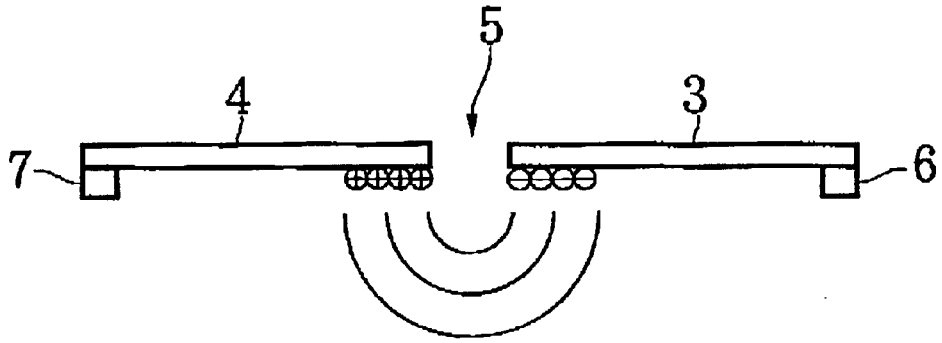
FIG. 11A is a cross-sectional view taken along the line XI—XI in FIG. 2, showing charges accumulated on scanning and sustaining electrodes when a sustaining voltage Vsa illustrated in FIG. 10 is applied to the scanning and sustaining electrodes in a sustaining period.
Figure 11B:
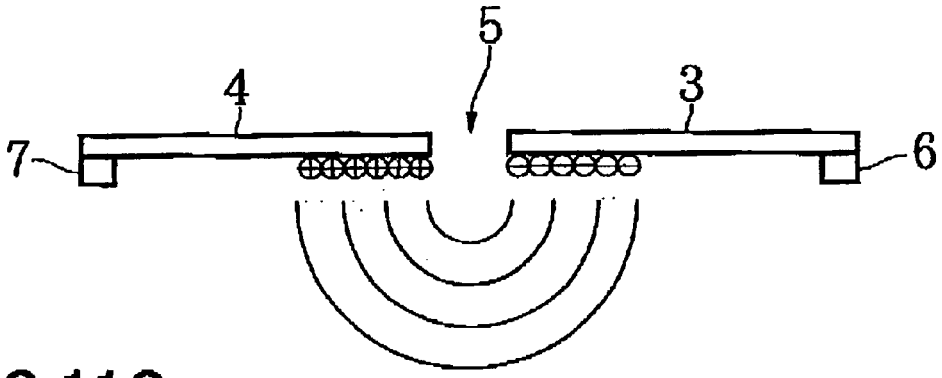
FIG. 11B is a cross-sectional view taken along the line XI—XI in FIG. 2, showing charges accumulated on scanning and sustaining electrodes when a sustaining voltage Vsb illustrated in FIG. 10 is applied to the scanning and sustaining electrodes in a sustaining period.
Figure 11C:
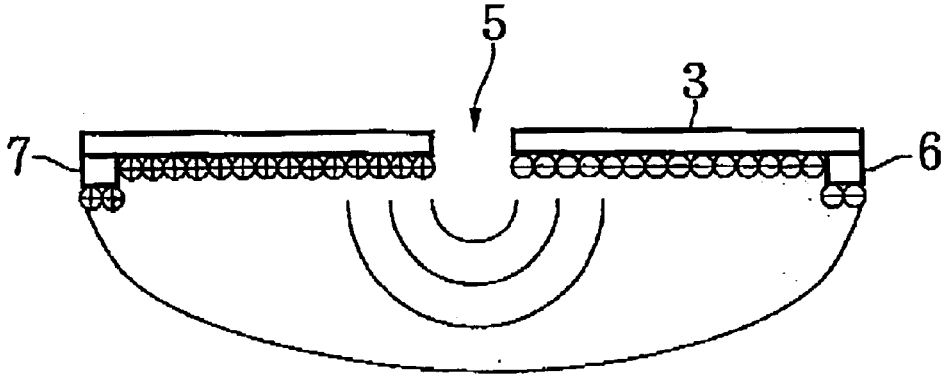
FIG. 11C is a cross-sectional view taken along the line XI—XI in FIG. 2, showing charges accumulated on scanning and sustaining electrodes when a sustaining voltage Vsc illustrated in FIG. 10 is applied to the scanning and sustaining electrodes in a sustaining period.
Figure 12A:
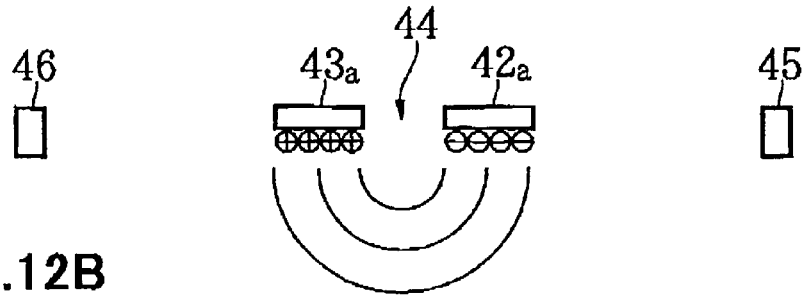
FIG. 12A is a cross-sectional view taken along the line XII—XII in FIG. 7, showing charges accumulated on scanning and sustaining electrodes when a sustaining voltage Vsa illustrated in FIG. 10 is applied to the scanning and sustaining electrodes in a sustaining period.
Figure 12B:
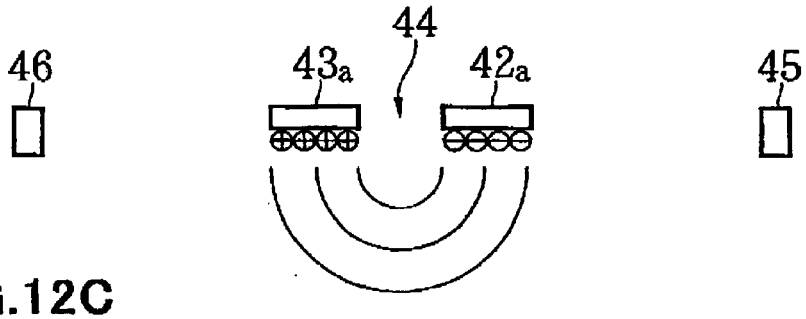
FIG. 12B is a cross-sectional view taken along the line XII—XII in FIG. 7, showing charges accumulated on scanning and sustaining electrodes when a sustaining voltage Vsb illustrated in FIG. 10 is applied to the scanning and sustaining electrodes in a sustaining period.
Figure 12C:
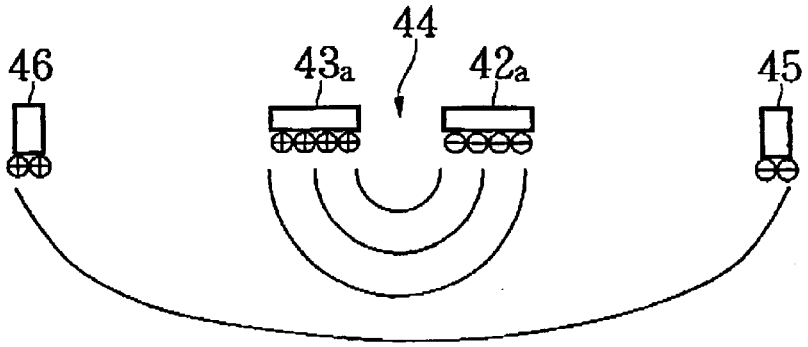
FIG. 12C is a cross-sectional view taken along the line XII—XII in FIG. 7, showing charges accumulated on scanning and sustaining electrodes when a sustaining voltage Vsc illustrated in FIG. 10 is applied to the scanning and sustaining electrodes in a sustaining period.

Hereinbelow is explained the reason why a cell in the plasma display panel 41 has a relation between a luminance and a sustaining voltage which relation is different from the same in a cell in the plasma display panel 1, with reference to FIGS. 11A to 11C and FIGS. 12A to 12C. FIGS. 11A to 11C are cross-sectional views taken along the line XI—XI in FIG. 2, illustrating a discharge area and charges accumulated on the scanning and sustaining electrodes in the case that the sustaining voltages Vsa to Vsc illustrated in FIG. 10 are applied to the scanning and sustaining electrodes in the sustaining period Ts, and FIGS. 12A to 12C are cross-sectional views taken along the line XII—XII in FIG. 7, illustrating a discharge area and charges accumulated on the scanning and sustaining electrodes in the case that the sustaining voltages Vsa to Vsc illustrated in FIG. 10 are applied to the scanning and sustaining electrodes in the sustaining period Ts. In FIGS. 11A to 11B and FIGS. 12A to 12C, symbols of an encircled plus (+) indicate positive charges, and symbols of an encircled minus (−) indicate negative charges.

A sustaining discharge starts in an area in which a scanning electrode and a sustaining electrode are located closest to each other. That is, a sustaining discharge starts in the vicinity of a discharge gap. A sustaining discharge being started, wall charges are rearranged such that voltages applied to the scanning and sustaining electrodes are cancelled. Accordingly, positive charges are attracted to the sustaining or scanning electrodes acting as a cathode, and negative charges are attracted to the sustaining or scanning electrodes acting as anode.

When the sustaining voltage Vs is relatively low, that is, the sustaining voltage Vs is equal to a sustaining voltage Vsa illustrated in FIG. 10, wall charges are accumulated on the scanning and sustaining electrodes only in the vicinity of a discharge gap, as illustrated in FIGS. 11A and 12A, because a sustaining discharge does not expand away from a discharge gap.

When the sustaining voltage Vs is relatively high, that is, the sustaining voltage Vs is equal to a sustaining voltage Vsc illustrated in FIG. 10, wall charges are accumulated entirely on the scanning and sustaining electrodes, as illustrated in FIGS. 11C and 12C, because a sustaining discharge expands away from a discharge gap.

Thus, accumulation of wall charges on the scanning and sustaining electrodes is not different between a cell in the plasma display panel 41 and a cell in the conventional plasma display panel 1, both when the sustaining voltage Vs is relatively low, that is, the sustaining voltage Vs is equal to a sustaining voltage Vsa illustrated in FIG. 10, and when the sustaining voltage Vs is relatively high, that is, the sustaining voltage Vs is equal to a sustaining voltage Vsc illustrated in FIG. 10.

In contrast, when the sustaining voltage Vs is equal to an intermediate voltage between relatively high and low voltages, that is, the sustaining voltage Vs is equal to a sustaining voltage Vsb illustrated in FIG. 10, accumulation of wall charges on the scanning and sustaining electrodes is different between a cell in the plasma display panel 41 and a cell in the conventional plasma display panel 1, as follows.

In a cell in the conventional plasma display panel 1, accumulation of wall charges on the scanning and sustaining electrodes is just intermediate between the accumulation illustrated in FIG. 11A and the accumulation illustrated in FIG. 11C, as illustrated in FIG. 11B. As a result, as shown in FIG. 10 with the line B, a luminance becomes higher proportionally, as the sustaining voltage Vs becomes higher within a range of the sustaining voltage Vs illustrated in FIG. 10 in a relation between a luminance and a sustaining voltage in a cell in the conventional plasma display panel 1.

In contrast, in the plasma display panel 41 in accordance with the first embodiment, the scanning electrode 42 and the sustaining electrode 43 are designed to be comprised of the first part 42*a*, 43*a* and the second parts 42*b*, 42*c* and 43*b*, 43*c*, respectively. Hence, in FIGS. 12A to 12C which are cross-sectional views taken along the line XII—XII in FIG. 7, electrodes other than the first parts 42*a* and 43*a* both located in the vicinity of the discharge gap 44 do not exist between the discharge gap 44 and the first trace electrode 45 and between the discharge gap 44 and the second trace electrode 46. That is, the scanning electrode 42 and the sustaining electrode 43 do not exist in a central area of a cell in which sustaining discharge is most intensive. Accordingly, when the sustaining voltage Vs is equal to an intermediate voltage, for instance, equal to the sustaining voltage Vsb illustrated in FIG. 10, an area in which charges are accumulated in a cell in the conventional plasma display panel 1 does no longer exist, and hence, as illustrated in FIG. 12B, the accumulation of charges on the scanning and sustaining electrodes is almost the same as the accumulation illustrated in FIG. 12A.

As explained above, in a cell in the plasma display panel 41, on application of a sustaining voltage to the scanning and sustaining electrodes, sustaining discharge starts in the vicinity of the discharge gap 44, as illustrated in FIG. 12A. Since the scanning electrode 42 and the sustaining electrode 43 does not exist in a central area of the cell in which sustaining discharge is most intensive, a sustaining discharge area is suppressed to expand in the intermediate area Var of a sustaining voltage Vs, and the accumulation of charges on the scanning electrode 42 and the sustaining electrode 43 remains almost unchanged, as illustrated in FIG. 12B. When the sustaining voltage Vs becomes higher than the intermediate area Var of a sustaining voltage Vs, sustaining discharge is generated between the first trace electrode 45 and the second trace electrode 46, as illustrated in FIG. 12C. Thereafter, a sustaining discharge area expands as the sustaining voltage Vs becomes higher, and a greater amount of charges is accumulated on the scanning electrode 42 and the sustaining electrode 43.

As a result, in a relation between a luminance and a sustaining voltage in a cell in the plasma display panel 41, a luminance becomes higher as the sustaining voltage Vs becomes higher within a range of the sustaining voltage Vs illustrated in FIG. 10, however, a luminance remains equal to the luminance B1, even if a sustaining voltage Vs becomes higher, in the intermediate area Var of the sustaining voltage Vs, as shown in FIG. 10 with the curve A.

In the first embodiment, the scanning electrode 42 is designed to include the second parts 42*b* and 42*c* through which the first part 42*a* makes electrical contact with the first trace electrode 45, and the sustaining electrode 43 is designed to include the second parts 43*b* and 43*c* through which the first part 43*a* makes electrical contact with the second trace electrode 46. A total width of the second parts 42*b* and 42*c* is smaller than a width of the scanning electrode 3 illustrated in FIG. 2, and a total width of the second parts 43*b* and 43*c* is smaller than a width of the sustaining electrode 4 illustrated in FIG. 2. Hence, the second parts

42*b*, 42*c*, 43*b* and 43*c* do not define a sustaining discharge area which influences a relation between a luminance and a sustaining voltage in a cell in the plasma display panel 41, and an amount of charges which influences the relation is not accumulated on the scanning electrode 42 and the sustaining electrode 43.

Figure 13:
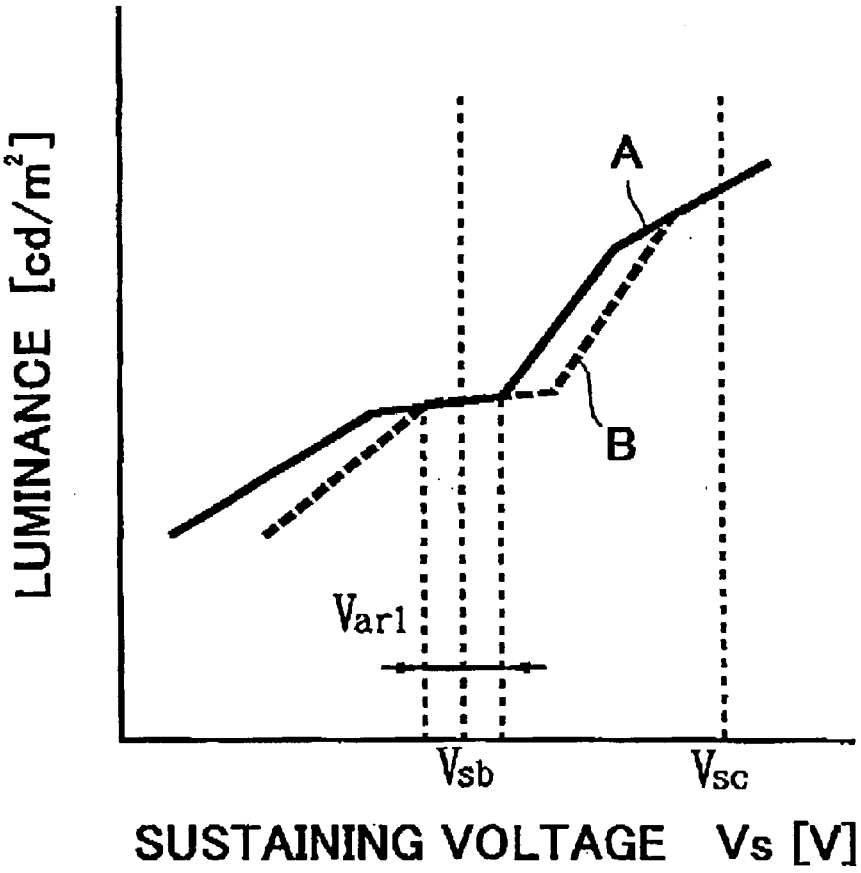
FIG. 13 is a graph showing a relation between a luminance and a sustaining voltage in a cell in the plasma display panel in accordance with the first embodiment of the present invention.

FIG. 13 shows an example of a relation between a luminance and a sustaining voltage in each of cells in the plasma display panel 41.

Some of the plasma display panels 41 include cells each having a relation between a luminance and a sustaining voltage which relation is different from others, as shown with curves A and B in FIG. 13. This is caused by variance in fabrication of a plasma display panel, such as a thickness of a dielectric layer, or a discharge gap between a scanning electrode and a sustaining electrode. However, as illustrated in FIG. 13, the relation includes an area Var1 in which a luminance remains constant, as an intermediate area of a sustaining voltage Vs.

The plasma display panel 41 can be driven in reduced power consumption and with a uniform gray scale by selecting one of the sustaining voltage Vsc close to a voltage at which a luminance is saturated, and the sustaining voltage Vsb included in the above-mentioned area Varl.

An operation of the plasma display panel 41 in the sustaining period Ts in a sub-field SF in the case that power consumption is reduced is identical with an operation of the conventional plasma display panel 1 in the sustaining period Ts except that the negative sustaining pulse $P_{SUN2}$ applied to all of the sustaining electrodes a plurality of times, as illustrated in FIG. 9(B) has an amplitude equal to the sustaining voltage Vsb, and that the negative sustaining pulse $P_{SUN1}$ applied to all of the scanning electrodes a plurality of times, as illustrated in FIG. 9(A) has an amplitude equal to the sustaining voltage Vsb. An operation of the plasma display panel 41 in the sustaining period Ts in another sub-field SF(p+x) in the case that power consumption is not reduced is identical with an operation of the conventional plasma display panel 1 in the sustaining period Ts.

Amplitudes of the sustaining voltage Vsc illustrated in FIG. 9(A) and FIG. 9(B) are equal to the amplitudes of the sustaining voltage Vs illustrated in FIG. 5(A) and FIG. 5(B) with respect to a sustaining voltage close to a voltage at which a luminance is saturated.

In the plasma display panel 41 in accordance with the first embodiment, the scanning electrode 42 and the sustaining electrode 43 are designed to have cutout in a central area in which sustaining discharge is most intensive. In addition, the negative sustaining pulses $P_{SUN1}$ and $P_{SUN2}$ applied to all of the scanning and sustaining electrodes a plurality of times in the sustaining period Ts in a certain sub-field SFp in a frame are designed to have an amplitude equal to the sustaining voltage Vsb in the area Varl in which a luminance is kept almost constant and which is an intermediate area of a sustaining voltage Vs in a curve indicating a relation between a luminance and a sustaining voltage. Furthermore, the negative sustaining pulses $P_{SUN1}$ and $P_{SUN2}$ applied to all of the scanning and sustaining electrodes a plurality of times in the sustaining period Ts in another sub-field SF(p+x) in a frame are designed to have an amplitude equal to the sustaining voltage Vsc at which a luminance is saturated, in a curve indicating a relation between a luminance and a sustaining voltage.

Thus, even if the plasma display panel 41 includes a variance in fabrication in a thickness of a dielectric layer, the discharge gap 44, and so on, or even if the number of cells in which a light is emitted in the plasma display panel 41 is varied, it would be possible to display images at a uniform gray scale with reduction in power consumption.

The plasma display panel 41 in accordance with the first embodiment makes it no longer necessary to fabricate scanning electrodes by the number equal to or greater than the number of scanning lines, and fabricate a trace electrode for each of scanning electrodes, unlike the earlier mentioned Japanese Patent Application Publication No. 5-135701. Accordingly, the plasma display panel 41 has no reduction in a luminance caused by reduction in an aperture ratio, and does not need to have a plurality of driver circuits for driving scanning circuits, resulting in that the plasma display panel 41 can be fabricated in a smaller size, in a simpler structure, and with lower costs.

According to the experiments having been conducted by the inventor, the inventor had fabricated the plasma display panel 41 having the area Var illustrated in FIG. 10 equal to about 5V in a range of a sustaining voltage Vs. In the fabricated plasma display panel 41, if the sustaining voltage Vs was changed by about 10V from a certain voltage included in the range of a sustaining voltage, both of a maximum luminance and a luminance of a half of a maximum could be accomplished in a cell.

Accordingly, if it is necessary, when a frame comprised of eight sub-fields, for instance, is to be displayed in the plasma display panel 41, to reduce power consumption because an average peak luminance (APL) level thereof is relatively high, a ratio of the number of sustaining pulses in each of the sub-fields is determined to be 1:2:4:8:16:32:64:128. Then, as illustrated in FIG. 9, the negative sustaining pulses $P_{SUN1}$ and $P_{SUN2}$ applied to all of the scanning and sustaining electrodes a plurality of times in a sustaining period Ts in a sub-field SFp in which a minimum luminance is to be displayed are designed to have an amplitude equal to the sustaining voltage Vsb, and the negative sustaining pulses $P_{SUN1}$ and $P_{SUN2}$ applied to all of the scanning and sustaining electrodes a plurality of times in the sustaining period Ts in another sub-field SF(p+x) in a frame are designed to have an amplitude equal to the sustaining voltage Vsc.

Thus, a weighting in a luminance in each of the sub-fields is 1:2:4:8:16:32:64:128. Hence, even when the total number SS of sustaining pluses in a frame is equal to 128, it would be possible to display images in 256 gray scales. This means that images can be displayed in gray scales about twice greater than the total number SS of sustaining pulses. Accordingly, the plasma display panel 41 in accordance with the first embodiment makes it possible to display images without reduction in the number of gray scales, even if the total number SS of sustaining pulses is decreased for reducing power consumption.

[Second Embodiment]

Figure 14:
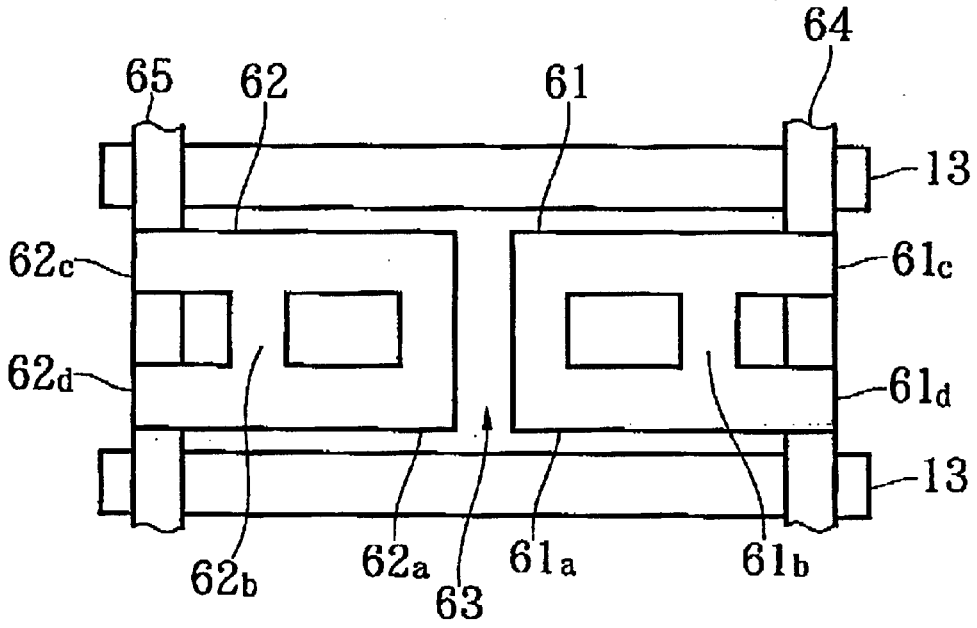
FIG. 14 is an upper view of a cell in the plasma display panel in accordance with the second embodiment, with a front insulating substrate being removed.

FIG. 14 is an upper view of a cell in an alternating current (AC) memory operation type plasma display panel in accordance with the second embodiment of the present invention, with a front insulating substrate being removed.

In the cell illustrated in FIG. 14, a scanning electrode 61 and a sustaining electrode 62 are formed on a lower surface of a front insulating substrate (not illustrated) such that they are spaced away from each other by a discharge gap 63. Each of the scanning electrode 61 and the sustaining electrode 62 is comprised of an electrically conductive transparent thin film composed, for instance, of tin oxide, indium oxide or indium tin oxide (ITO).

The scanning electrode 61 is comprised of two first parts 61*a* and 61*b* both extending in parallel in a column direction (an up-down direction in FIG. 14), and two second parts 61*c* and 61*d* both extending in parallel in a row direction (a left-right direction in FIG. 14). The first part 61*a* faces the discharge gap 63, and the first part 61*b* is spaced away from the first part 61*a* by a distance slightly greater than the discharge gap 63, at the opposite side of the first part 61*a* about the discharge gap 63. The first parts 61*a* and 61*b* are connected at their opposite ends to the second parts 61*c* and 61*d*.

The sustaining electrode 62 is comprised of two first parts 62*a* and 62*b* both extending in parallel in the column direction, and two second parts 62*c* and 62*d* both extending in parallel in the row direction. The first part 62*a* faces the discharge gap 63, and the first part 62*b* is spaced away from the first part 62*a* by a distance slightly greater than the discharge gap 63, at the opposite side of the first part 62*a* about the discharge gap 63. The first parts 62*a* and 62*b* are connected at their opposite ends to the second parts 62*c* and 62*d*.

The scanning electrode 61 and the sustaining electrode 62 are equal or similar in size to each other. The scanning electrode 61 and the sustaining electrode 62 are located in mirror-symmetry with each other about an imaginary centerline of the discharge gap 63 extending in the column direction. The first parts 61*a*, 61*b*, 62*a* and 62*b* are almost equal in width to one another, and the second parts 61*c*, 61*d*, 62*c* and 62*d* are almost equal in width to one another.

A first trace electrode 64 in the form of a stripe extends in the column direction just below lower surfaces of the second parts 61*c* and 61*d* of the scanning electrode 61 at their distal ends. The first trace electrode 64 makes electrical contact with the second parts 61*c* and 61*d* of the scanning electrode 61 at their distal ends.

A second trace electrode 65 in the form of a stripe extends in the column direction just below lower surfaces of the second parts 62*c* and 62*d* of the sustaining electrode 62 at their distal ends. The second trace electrode 62 makes electrical contact with the second parts 62*c* and 62*d* of the sustaining electrode 62 at their distal ends.

The first and second trace electrodes 64 and 65 are comprised of a metal film such as a thick silver film or a thin aluminum or copper film. The first and second trace electrodes 64 and 65 reduce electrical resistance between the scanning and sustaining electrodes 61 and 62 both having a low electrical conductivity, and a driver circuit electrically connected to the scanning and sustaining electrodes 61 and 62.

The scanning electrode 61 makes electrical contact with a scanning electrode located adjacent in the column direction, through the first trace electrode 64, and the sustaining electrode 62 makes electrical contact with a sustaining electrode located adjacent in the column direction, through the second trace electrode 65.

Though not illustrated, the plasma display panel in accordance with the second embodiment is designed to include a dielectric layer and a protection layer, similarly to the plasma display panel 1 illustrated in FIG. 1. Furthermore, the plasma display panel is designed to include a rear insulating substrate, data electrodes, a dielectric layer, partition walls, three phosphor layers, and discharge gas filled in a discharge gas space all of which are similar to those illustrated in FIG. 1. FIG. 14 illustrates only the partition walls 18 among them.

In a relation between a luminance and a sustaining voltage in the cell, a luminance becomes higher proportionally as a sustaining voltage becomes higher, as a whole, in a range of a sustaining voltage in which a luminance is not saturated. However, the relation includes two intermediate areas in which a luminance remains almost unchanged, even if a sustaining voltage becomes higher. The reason is as follows.

On application of a sustaining voltage to the scanning and sustaining electrodes, sustaining discharge starts in the vicinity of the discharge gap 63. Since the scanning electrode 61 does not exist between the first parts 61*a* and 61*b*, and the sustaining electrode 62 does not exist between the first parts 62*a* and 62*b*, a sustaining discharge area is suppressed to expand in a first intermediate area of a sustaining voltage, and the accumulation of charges on the scanning electrode 61 and the sustaining electrode 62 remains almost unchanged.

When the sustaining voltage becomes higher than the first intermediate area of a sustaining voltage, sustaining discharge is generated between the first parts 61*b* and 62*b*. However, since the scanning electrode 61 does not exist between the first part 61*b* and the first trace electrode 64, and the sustaining electrode 62 does not exist between the first part 62*b* and the second trace electrode 65, a sustaining discharge area is suppressed to expand in a second intermediate area of a sustaining voltage, and the accumulation of charges on the scanning electrode 61 and the sustaining electrode 62 remains almost unchanged.

Thereafter, a sustaining discharge area expands as a sustaining voltage becomes higher, and a greater amount of charges is accumulated on the scanning electrode 61 and the sustaining electrode 62.

As a result, in a relation between a luminance and a sustaining voltage in a cell in the plasma display panel, a luminance becomes higher as the sustaining voltage becomes higher within a range of the sustaining voltage in which a luminance is not saturated, however, a luminance remains almost unchanged, even if a sustaining voltage becomes higher, in the first and second intermediate areas of a sustaining voltage.

In the second embodiment, a gray scale which can be displayed by one sustaining pulse can be selected among three voltages, that is, a conventionally used sustaining voltage close to a voltage at which a luminance is saturated, a sustaining voltage within the first intermediate area, and a sustaining voltage within the second intermediate area. Accordingly, the second embodiment provides the greater number of options to control a luminance than the above-mentioned first embodiment, ensuring that since power consumption can be controlled in a broader range, it would be possible to control power consumption with increased accuracy.

In addition, a sustaining voltage is varied in a smaller range in the second embodiment than in the first embodiment, and hence, a luminance varies in a small range, ensuring high quality in displayed images.

A driver circuit for driving the plasma display panel in accordance with the second embodiment includes a sustaining voltage control circuit having the following structure, in place of the sustaining voltage control circuit 52 in the driver circuit illustrated in FIG. 8.

The sustaining voltage control circuit in the second embodiment receives the computation results CR from the second circuit 33, and further receives the total number SS of sustaining pulses and data Ds indicative of the number of sustaining pulses in each of sub-fields, from the third circuit 34. The sustaining voltage control circuit determines an amplitude of a sustaining voltage for each of sub-fields among the above-mentioned three amplitudes, based on the received computation results CR and the total number SS of sustaining pulses. Then, the sustaining voltage control circuit transmits an amplitude selection signal $S_{SA}$ indicative of the thus determined amplitude, and the data Ds to the fourth circuit 35.

[Third Embodiment]

Figure 15:
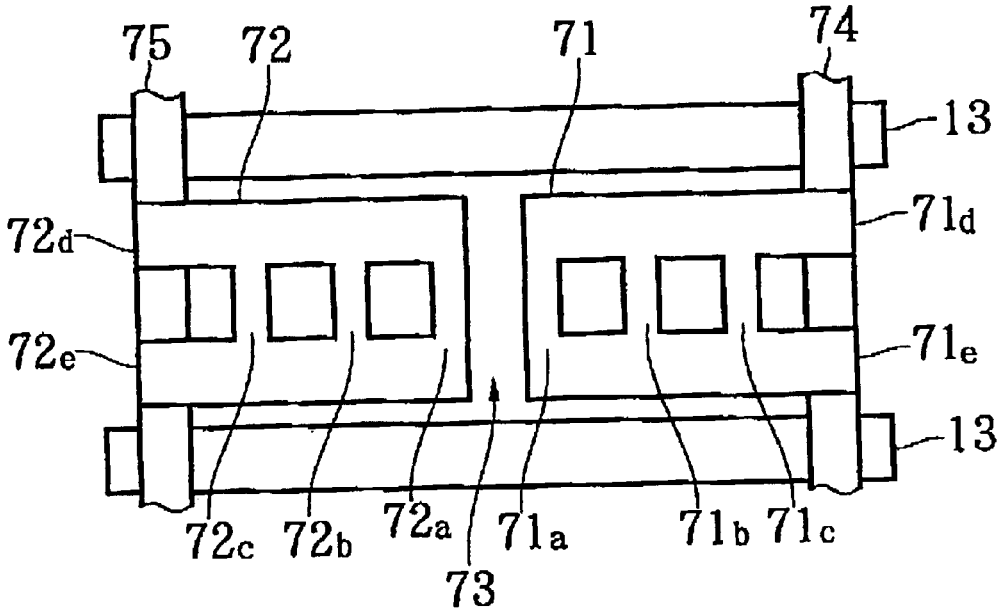
FIG. 15 is an upper view of a cell in the plasma display panel in accordance with the third embodiment, with a front insulating substrate being removed.

FIG. 15 is an upper view of a cell in an alternating current (AC) memory operation type plasma display panel in accordance with the third embodiment of the present invention, with a front insulating substrate being removed.

In the cell illustrated in FIG. 15, a scanning electrode 71 and a sustaining electrode 72 are formed on a lower surface of a front insulating substrate (not illustrated) such that they are spaced away from each other by a discharge gap 73. Each of the scanning electrode 71 and the sustaining electrode 72 is comprised of an electrically conductive transparent thin film composed, for instance, of tin oxide, indium oxide or indium tin oxide (ITO).

The scanning electrode 71 is comprised of three first parts 71*a*, 71*b* and 71*c* all extending in parallel in a column direction (an up-down direction in FIG. 15), and two second parts 71*d* and 71*e* both extending in parallel in a row direction (a. left-right direction in FIG. 15). The first part 71*a* faces the discharge gap 73, and the first part 71*b* is spaced away from the first part 71*a* by a distance slightly greater than the discharge gap 73, at the opposite side of the first part 71*a* about the discharge gap 73. The first part 71*c* is spaced away from the first part 71*b* by a distance slightly greater than the discharge gap 73, at the opposite side of the first part 71*b* about the discharge gap 73. The first parts 71*a*, 71*b* and 71*c* are connected at their opposite ends to the second parts 71*d* and 71*e*.

The sustaining electrode 72 is comprised of three first parts 72*a*, 72*b* and 72*c* all extending in parallel in the column direction, and two second parts 72*d* and 72*e* both extending in parallel in the row direction. The first part 72*a* faces the discharge gap 73, and the first part 72*b* is spaced away from the first part 72*a* by a distance slightly greater than the discharge gap 73, at the opposite side of the first part 72*a* about the discharge gap 73. The first part 72*c* is spaced away from the first part 72*b* by a distance slightly greater than the discharge gap 73, at the opposite side of the first part 72*b* about the discharge gap 73. The first parts 72*a*, 72*b* and 72*c* are connected at their opposite ends to the second parts 72*d* and 72*e*.

The scanning electrode 71 and the sustaining electrode 72 are equal or similar in size to each other. The scanning electrode 71 and the sustaining electrode 72 are located in mirror-symmetry with each other about an imaginary centerline of the discharge gap 73 extending in the column direction. The first parts 71*a*, 71*b*, 71*c*, 72*a*, 72*b* and 72*c* are almost equal in width to one another, and the second parts 71*d*, 71*e*, 72*d* and 72*e* are almost equal in width to one another.

A first trace electrode 74 in the form of a stripe extends in the column direction just below lower surfaces of the second parts 71*d* and 71*e* of the scanning electrode 71 at their distal ends. The first trace electrode 74 makes electrical contact with the second parts 71*d* and 71*e* of the scanning electrode 71 at their distal ends.

A second trace electrode 75 in the form of a stripe extends in the column direction just below lower surfaces of the second parts 72*d* and 72*e* of the sustaining electrode 72 at their distal ends. The second trace electrode 75 makes electrical contact with the second parts 72*d* and 72*e* of the sustaining electrode 72 at their distal ends.

The first and second trace electrodes 74 and 75 are comprised of a metal film such as a thick silver film or a thin aluminum or copper film. The first and second trace electrodes 74 and 75 reduce electrical resistance between the scanning and sustaining electrodes 71 and 72 both having a low electrical conductivity, and a driver circuit electrically connected to the scanning and sustaining electrodes 71 and 72.

The scanning electrode 71 makes electrical contact with a scanning electrode located adjacent in the column direction, through the first trace electrode 74, and the sustaining electrode 72 makes electrical contact with a sustaining electrode located adjacent in the column direction, through the second trace electrode 75.

Though not illustrated, the plasma display panel in accordance with the third embodiment is designed to include a dielectric layer and a protection layer, similarly to the plasma display panel 1 illustrated in FIG. 1. Furthermore, the plasma display panel is designed to include a rear insulating substrate, data electrodes, a dielectric layer, partition walls, three phosphor layers, and discharge gas filled in a discharge gas space all of which are similar to those illustrated in FIG. 1. FIG. 15 illustrates only the partition walls 13 among them.

In a relation between a luminance and a sustaining voltage in the cell in the third embodiment, a luminance becomes higher proportionally as a sustaining voltage becomes higher, as a whole, in a range of a sustaining voltage in which a luminance is not saturated. However, the relation includes three intermediate areas in which a luminance remains almost unchanged, even if a sustaining voltage becomes higher. The reason is as follows.

On application of a sustaining voltage to the scanning and sustaining electrodes, sustaining discharge starts in the vicinity of the discharge gap 73. Since the scanning electrode 71 does not exist between the first parts 71*a* and 71*b*, and the sustaining electrode 72 does not exist between the first parts 72*a* and 72*b*, a sustaining discharge area is suppressed to expand in a first intermediate area of a sustaining voltage, and the accumulation of charges on the scanning electrode 71 and the sustaining electrode 72 remains almost unchanged.

When the sustaining voltage becomes higher than the first intermediate area of a sustaining voltage, sustaining discharge is generated between the first parts 71*b* and 72*b* spaced away from each other. However, since the scanning electrode 71 does not exist between the first parts 71*b* and 71*c*, and the sustaining electrode 72 does not exist between the first parts 72*b* and 72*c*, a sustaining discharge area is suppressed to expand in a second intermediate area of a sustaining voltage, and the accumulation of charges on the scanning electrode 71 and the sustaining electrode 72 remains almost unchanged.

When the sustaining voltage becomes higher than the second intermediate area of a sustaining voltage, sustaining discharge is generated between the first parts 71*c* and 72*c* spaced away from each other. However, since the scanning electrode 71 does not exist between the first part 71*c* and the first trace electrode 74, and the sustaining electrode 72 does not exist between the first part 72*c* and the second trace electrode 75, a sustaining discharge area is suppressed to expand in a third intermediate area of a sustaining voltage, and the accumulation of charges on the scanning electrode 71 and the sustaining electrode 72 remains almost unchanged.

Thereafter, a sustaining discharge area expands as a sustaining voltage becomes higher, and a greater amount of charges is accumulated on the scanning electrode 71 and the sustaining electrode 72.

As a result, in a relation between a luminance and a sustaining voltage in a cell in the plasma display panel, a luminance becomes higher as the sustaining voltage becomes higher within a range of the sustaining voltage in which a luminance is not saturated, however, a luminance remains almost unchanged, even if a sustaining voltage becomes higher, in the first, second and third intermediate areas of a sustaining voltage.

In the third embodiment, a gray scale which can be displayed by one sustaining pulse can be selected among four voltages, that is, a conventionally used sustaining voltage close to a voltage at which a luminance is saturated, a sustaining voltage within the first intermediate area, a sustaining voltage within the second intermediate area, and a sustaining voltage within the third intermediate area. Accordingly, the third embodiment provides the greater number of options to control a luminance than the above-mentioned first and second embodiments, ensuring that since power consumption can be controlled in a broader range, it would be possible to control power consumption with increased accuracy.

In addition, a sustaining voltage is varied in a smaller range in the third embodiment than in the first and second embodiments, and hence, a luminance varies in a small range, ensuring high quality in displayed images.

A driver circuit for driving the plasma display panel in accordance with the third embodiment includes a sustaining voltage control circuit having the following structure, in place of the sustaining voltage control circuit 52 in the driver circuit illustrated in FIG. 8.

The sustaining voltage control circuit in the third embodiment receives the computation results CR from the second circuit 33, and further receives the total number SS of sustaining pulses and data Ds indicative of the number of sustaining pulses in each of sub-fields, from the third circuit 34. The sustaining voltage control circuit determines an amplitude of a sustaining voltage for each of sub-fields among the above-mentioned four amplitudes, based on the received computation results CR and the total number SS of sustaining pulses. Then, the sustaining voltage control circuit transmits an amplitude selection signal $S_{SA}$ indicative of the thus determined amplitude, and the data Ds to the fourth circuit 35.

[Fourth Embodiment]

Figure 16:
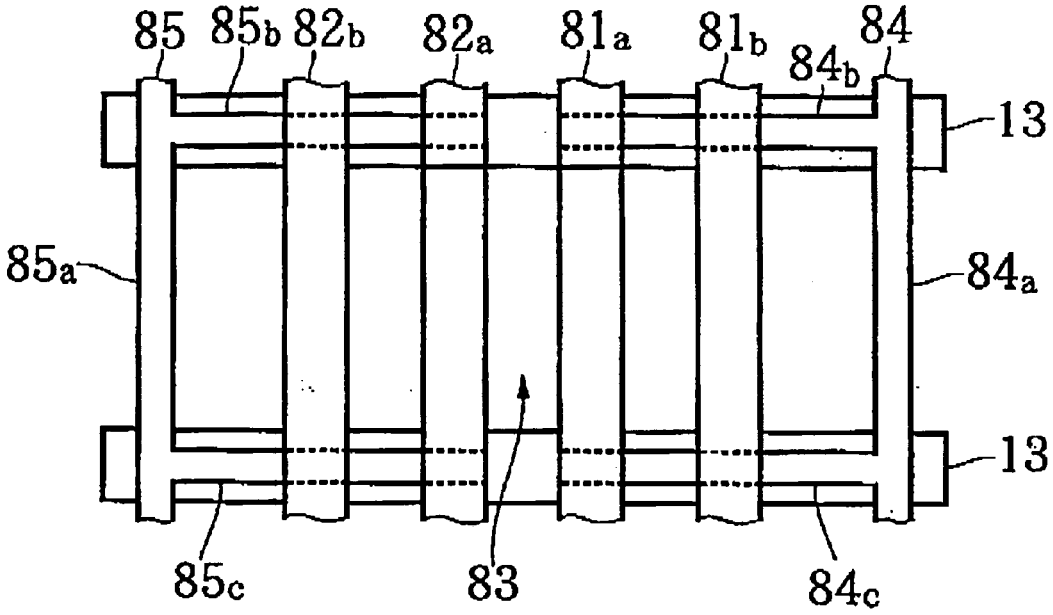
FIG. 16 is an upper view of a cell in the plasma display panel in accordance with the fourth embodiment, with a front insulating substrate being removed.

FIG. 16 is an upper view of a cell in an alternating current (AC) memory operation type plasma display panel in accordance with the fourth embodiment-of the present invention, with a front insulating substrate being removed.

In the cell illustrated in FIG. 16, a scanning electrode 81*a* and a sustaining electrode 82*a* both in the form of a stripe and extending in a column direction (an up-down direction in FIG. 16) are formed on a lower surface of a front insulating substrate (not illustrated) such that they are spaced away from each other by a discharge gap 83. A scanning electrode 81*b* in the form of a stripe and extending in the column direction is spaced away from the scanning electrode 81*a* by a distance almost equal to a discharge gap 83, at the opposite side of the scanning electrode 81*a* about the discharge gap 83. A sustaining electrode 82*b* in the form of a stripe and extending in the column direction is spaced away from the sustaining electrode 82*a* by a distance almost equal to a discharge gap 88, at the opposite side of the sustaining electrode 82*a* about the discharge gap 83. The scanning electrodes 81*a*, 81*b* and the sustaining electrodes 82*a*, 82*b* are almost equal in width to one another. Each of the scanning electrodes 81*a*, 81*b* and the sustaining electrodes 82*a*, 82*b* is comprised of an electrically conductive transparent thin film composed, for instance, of tin oxide, indium oxide or indium tin oxide (ITO).

A first trace electrode 84 is formed below the scanning electrodes 81*a* and 81*b*, and a second trace electrode 85 is formed below the sustaining electrodes 82*a* and 82*b*.

The first trace electrode 84 is comprised of a first part 84*a* spaced away from the scanning electrode 81*b* by a predetermined distance and extending in the column direction, and second parts 84*b* and 84*c* extending from the first part 84*a* in parallel in a row direction (a left-right direction in FIG. 16) to the scanning electrode 81*a* to face the discharge gap 83. The second parts 84*b* and 84*c* are formed on the partition walls 13 extending in the row direction on a rear insulating substrate to partition cells. Each of the second parts 84*b* and 84*c* makes electrical contact at a distal end thereof with the scanning electrode 81*a*, and at an intermediate portion with the scanning electrode 81*b*.

The first trace electrode 85 is comprised of a first part 85*a* spaced away from the sustaining electrode 82*b* by a predetermined distance and extending in the column direction, and second parts 85*b* and 85*c* extending from the first part 85*a* in parallel in the row direction to the sustaining electrode 82*a* to face the discharge gap 83. The second parts 85*b* and 85*c* are formed on the partition walls 13 extending in the row direction on a rear insulating substrate to partition cells. Each of the second parts 85*b* and 85*c* makes electrical contact at a distal end thereof with the sustaining electrode 82*a*, and at an intermediate portion with the sustaining electrode 82*b*.

The first and second trace electrodes 84 and 85 are comprised of a metal film such as a thick silver film or a thin aluminum or copper film. The first and second trace electrodes 84 and 85 reduce electrical resistance between the scanning and sustaining electrodes 81 and 82 both having a low electrical conductivity, and a driver circuit electrically connected to the scanning and sustaining electrodes 81 and 82. The first and second trace electrodes 84 and 85 are identical or similar in size to each other, and are located in mirror-symmetry with each other about an imaginary centerline of the discharge gap 83 extending in the column direction.

Though not illustrated, the plasma display panel in accordance with the fourth embodiment is designed to include a dielectric layer and a protection layer, similarly to the plasma display panel 1 illustrated in FIG. 1. Furthermore, the plasma display panel is designed to include a rear insulating substrate, data electrodes, a dielectric layer, partition walls, three phosphor layers, and discharge gas filled in a discharge gas space all of which are similar to those illustrated in FIG. 1. FIG. 16 illustrates only the partition walls 13 among them.

In a relation between a luminance and a sustaining voltage in the cell in the fourth embodiment, a luminance becomes higher proportionally as a sustaining voltage becomes higher, as a whole, in a range of a sustaining voltage in which a luminance is not saturated. However, the relation includes two intermediate areas in which a luminance remains almost unchanged, even if a sustaining voltage becomes higher. The reason is the same as the reason having been explained in the second embodiment.

The scanning electrodes 81*a* and 81*b* in the fourth embodiment do not have parts corresponding to the second parts 42*b* and 42*c* illustrated in FIG. 7, the second parts 62*c* and 61*d* illustrated in FIG. 14, and the second parts 71*d* and 71*e* illustrated in FIG. 15. Similarly, the sustaining electrodes 82*a* and 82*b* in the fourth embodiment do not have parts corresponding to the second parts 43*b* and 43*c* illustrated in FIG. 7, the second parts 62*c* and 62*d* illustrated in FIG. 14, and the second parts 72*d* and 72*e* illustrated in FIG. 15. Accordingly, the above-mentioned two intermediate areas in the fourth embodiment have a width greater than the same in the above-mentioned fist to third embodiments. Thus, even if plasma display panels includes cells having relations between a luminance and a sustaining voltage which relations are different from one another due to variance in fabrication in a thickness of a dielectric layer, discharge gap, and so on, the plasma display panels have an intermediate area of a sustaining voltage in which a luminance remains almost constant.

As a result, it would be possible to select an appropriate sustaining voltage among a plurality of sustaining voltages within the intermediate areas, ensuring broader designability.

In addition, since the scanning electrodes 81*a* and 81*b* and the sustaining electrodes 82*a* and 82*b* are stripe-shaped, they can be fabricated under the same conditions as the conditions for fabricating the scanning electrode 3 and the sustaining electrode 4 in the conventional plasma display panel.

A method of and a driver circuit for driving the plasma display panel in accordance with the fourth embodiment are the same as those in the second embodiment.

[Fifth Embodiment]

Figure 17:
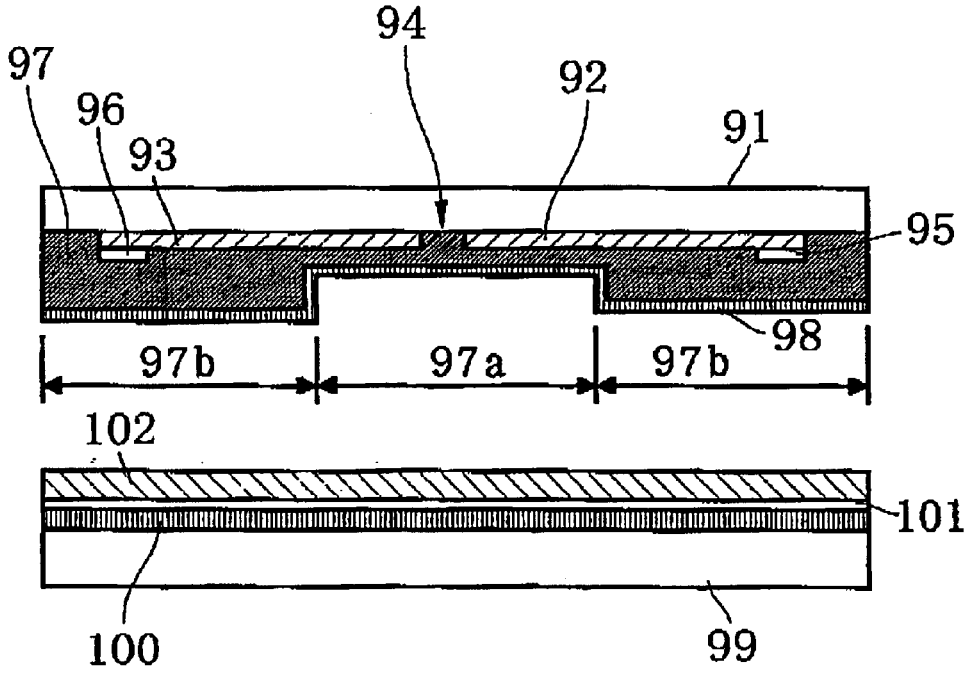
FIG. 17 is a cross-sectional view of a cell in the plasma display panel in accordance with the fifth embodiment.

FIG. 17 is a cross-sectional view of a cell in an alternating current (AC) memory operation type plasma display panel in accordance with the fifth embodiment of the present invention.

As illustrated in FIG. 17, a scanning electrode 92 and a sustaining electrode 93 both extending in a column direction, that is, a direction perpendicular to a plane of the drawing are formed on a lower surface of a front insulating substrate 91. The scanning electrode 92 and the sustaining electrode 93 are both in the form of a stripe, and spaced away from each other by a discharge gap 94. The front insulating substrate 91 and a later mentioned rear insulating substrate 91 are composed of soda-lime glass, for instance. Both of the scanning electrode 92 and the sustaining electrode 93 are comprised of an electrically conductive transparent film composed of tin oxide, indium oxide or indium tin oxide (ITO), for instance.

A first trace electrode 95 extends in the column direction on a lower surface and along an edge of the scanning electrode 92. A second electrode 96 extends in the column direction on a lower surface and along an edge of the sustaining electrode 93. The first and second trace electrodes 95 and 96 are comprised of a metal film such as a thick silver film or a thin aluminum or copper film, and reduce electrical resistance between the scanning and sustaining electrodes 92 and 93 both having a low electrical conductivity, and a driver circuit electrically connected to the scanning and sustaining electrodes 92 and 93.

A transparent dielectric layer 97 is formed on a lower surface of the front insulating substrate 91, covering the scanning electrode 92, the sustaining electrode 93, the first trace electrode 95 and the second trace electrode 96 therewith. The dielectric layer 97 is composed of glass having a low melting point, for instance.

As illustrated in FIG. 17, the dielectric layer 97 is designed to have a first portion 97*a* covering therewith an area including the discharge gap 94, and a second portion 97*b* other than the first portion 97*a*. The first portion 97*a* has a thickness smaller than a thickness of the second portion 97*b*.

The dielectric layer 97 is covered at a lower surface thereof with a protection layer 98 which protects the dielectric layer 97 from ion bombardment in discharge. The protection layer 98 is composed of a material having a high secondary-electron emission coefficiency, and hence, a high resistance to sputtering, such as magnesium oxide.

On an upper surface of the rear insulating substrate 99 is formed a plurality of stripe-shaped data electrodes 100 arranged in the column direction and extending in a row direction (a left-right direction in FIG. 17), that is, a direction perpendicular to a direction in which the scanning electrode 92 and the sustaining electrode 93 extend. The data electrodes 100 are comprised of a silver film, for instance.

A white dielectric layer 101 is formed on an upper surface of the rear insulating substrate 99, covering the data electrodes 100 therewith. Though not illustrated, stripe-shaped partition walls extending in the row direction are formed on an upper surface of the dielectric layer 101 for partitioning cells such that the partition walls do not overlap the data electrodes 100 when viewed from a top.

Phosphor layers 102 are formed on an upper surface of the dielectric layer 101 and sidewalls of the partition walls. The phosphor layers 102 convert ultra-violet rays produced by gas discharge, into visible lights. The phosphor layers 102 extend in the raw direction.

Each of spaces surrounded by a lower surface of the protection layer 98, each of surfaces of the phosphor layers 102, and sidewalls of the adjacent partition walls defines a discharge gas space) which is filled with discharge gas comprised of xenon (Xe), helium (He) or neon (Ne) alone or in combination at a predetermined pressure. A region surrounded by the scanning electrodes 92, the sustaining electrodes 93, the first trace electrode 95, the second trace electrode 96, the data electrodes 100, the phosphor layer 102, and the discharge gas space defines a cell.

The scanning electrodes 92, the sustaining electrodes 93, the first trace electrode 95 and the second trace electrode 96 in the cell are identical in shape with those in a cell in the conventional plasma display panel 1 illustrated in FIGS. 1 and 2. However, the dielectric layer 97 in the fifth embodiment is different in shape from the dielectric layer 12 in the conventional plasma display panel 1 illustrated in FIG. 1. Specifically, the dielectric layer 97 in the fifth embodiment is designed to include the first portion 97*a* including the discharge gap 94 and an area therearound, and the second portion 97*b* other than the first portion 97*a*, wherein the first portion 97*a* is smaller in thickness than the second portion 97*b*.

Since the dielectric layer 97 is formed thinner around the discharge gap 94 as mentioned above, an electrostatic capacity in an area around the discharge gap 94 is greater than the same in other area. Accordingly, when a sustaining voltage is applied to a sustaining driver constituting a driver circuit for the plasma display panel, a voltage difference around the discharge gap 94 is greater than the same in other area in which the dielectric layer 97 is thicker than in an area around the discharge gap 94, even if the sustaining voltage is relatively small.

In other words, since an electrostatic capacity in an area other than an area around the discharge gap 94 is smaller than the same in an area around the discharge gap 94, unless a sustaining voltage higher than a sustaining voltage to be applied to an area around the discharge gap 94 is applied to an area other than an area around the discharge gap 94, a voltage difference in an area other than an area around the discharge gap 94 would not be at the same level with a voltage difference in an area around the discharge gap 94. Hence, sustaining discharge can be generated in an area around the discharge gap 94 even by a relatively low sustaining voltage, whereas it would be necessary to apply a sustaining voltage higher than a sustaining voltage to be applied to an area around the discharge gap 94, to an area other than an area around the discharge gap 94 in order to generate sustaining discharge in an area other than an area around the discharge gap 94. This means that it is possible to control a sustaining discharge area by varying a sustaining voltage. That is, the cell in the fifth embodiment has the same relation between a luminance and a sustaining voltage as the relation illustrated in FIG. 10 with the curve A.

Accordingly, it would be possible to have the same advantages as those obtained in the above-mentioned first embodiment, by driving the plasma display panel in the fifth embodiment, having the above-mentioned cell, in accordance with the method having been explained in the above-mentioned first embodiment.

[Sixth Embodiment]

Figure 18:
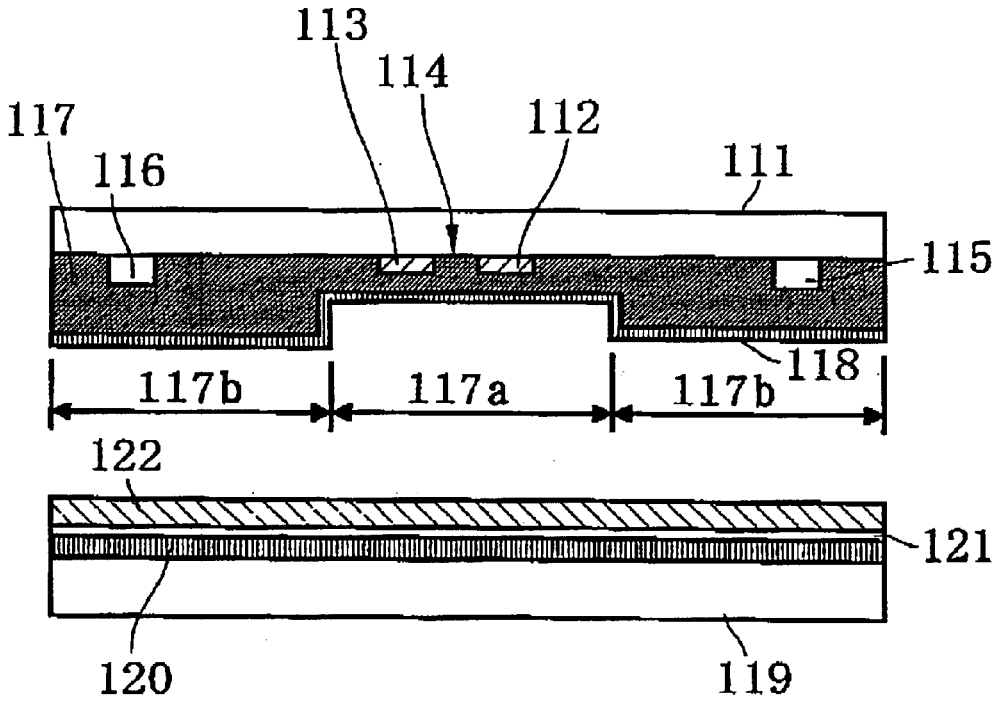
FIG. 18 is a cross-sectional view of a cell in the plasma display panel in accordance with the sixth embodiment.

FIG. 18 is a cross-sectional view of a cell in an alternating current (AC) memory operation type plasma display panel in accordance with the sixth embodiment of the present invention.

As illustrated in FIG. 18, a scanning electrode 112 and a sustaining electrode 113 are formed on a lower surface of a front insulating substrate 111. The scanning electrode 112 and the sustaining electrode 113 are spaced away from each other by a discharge gap 114. The front insulating substrate 111 and a later mentioned rear insulating substrate 119 are composed of soda-lime glass, for instance. Both of the scanning electrode 112 and the sustaining electrode 113 are comprised of an electrically conductive transparent film composed of tin oxide, indium oxide or indium tin oxide (ITO), for instance.

The scanning electrode 112 has the same shape as that of the scanning electrode 42 illustrated in FIG. 7. Specifically, the scanning electrode 112 is comprised of a first part extending in a column direction (a direction perpendicular to a plane of FIG. 18), and two second parts extending in parallel in a row direction (a left-right direction in FIG. 18). The first part is connected at its opposite ends to the second parts.

The sustaining electrode 113 has the same shape as that of the sustaining electrode 43 illustrated in FIG. 7. Specifically, the sustaining electrode 113 is comprised of a first part extending in the column direction, and two second parts extending in parallel in the row direction. The first part is connected at its opposite ends to the second parts.

The scanning electrode 112 and the sustaining electrode 113 are equal or similar in size to each other. The scanning electrode 112 and the sustaining electrode 113 are located in mirror-symmetry with each other about an imaginary centerline of a discharge gap 114 extending in the column direction.

A first trace electrode 115 in the form of a stripe extends in the column direction just below lower surfaces of the second parts of the scanning electrode 112 at their distal ends. The first trace electrode 115 makes electrical contact with the second parts of the scanning electrode 112 at their distal ends. Similarly, a second trace electrode 116 in the form of a stripe extends in the column direction just below lower surfaces of the second parts of the sustaining electrode 113 at their distal ends. The second trace electrode 116 makes electrical contact with the second parts of the sustaining electrode 113 at their distal ends.

The first and second trace electrodes 115 and 116 are comprised of a metal film such as a thick silver film or a thin aluminum or copper film. The first and second trace electrodes 115 and 116 reduce electrical resistance between the scanning and sustaining electrodes 112 and 113 both having a low electrical conductivity, and a driver circuit electrically connected to the scanning and sustaining electrodes 112 and 113.

The scanning electrode 112 makes electrical contact with a scanning electrode located adjacent in the column direction, through the first trace electrode 115, and the sustaining electrode 113 makes electrical contact with a sustaining electrode located adjacent in the column direction, through the second trace electrode 116.

A transparent dielectric layer 117 is formed on a lower surface of the front insulating substrate 111, covering the scanning electrode 112, the sustaining electrode 113, the first trace electrode 115 and the second trace electrode 116 therewith. The dielectric layer 117 is composed of glass having a low melting point, for instance.

As illustrated in FIG. 18, the dielectric layer 117 is designed to have a first portion 117*a* covering therewith an area including a discharge gap 114, and a second portion 117*b* other than the first portion 117*a*. The first portion 117*a* has a thickness smaller than a thickness of the second portion 117*b*.

The dielectric layer 117 is covered at a lower surface thereof with a protection layer 118 which protects the dielectric layer 117 from ion bombardment in discharge. The protection layer 118 is composed of a material having a high secondary-electron emission coefficiency, and hence, a high resistance to sputtering, such as magnesium oxide.

On an upper surface of the rear insulating substrate 119 is formed a plurality of stripe-shaped data electrodes 120 arranged in the column direction and extending in the row direction. The data electrodes 120 are comprised of a silver film, for instance.

A white dielectric layer 121 is formed on an upper surface of the rear insulating substrate 119, covering the data electrodes 120 therewith. Though not illustrated, stripe-shaped partition walls extending in the row direction are formed on an upper surface of the dielectric layer 121 for partitioning cells such that the partition walls do not overlap the data electrodes 120 when viewed from a top.

Phosphor layers 122 are formed on an upper surface of the dielectric layer 121 and sidewalls of the partition walls. The phosphor layers 122 convert ultra-violet rays produced by gas discharge, into visible lights. The phosphor layers 122 extend in the raw direction.

Each of spaces surrounded by a lower surface of the protection layer 118, each of surfaces of the phosphor layers 122, and sidewalls of the adjacent partition walls defines a discharge gas space, which is filled with discharge gas comprised of xenon (Xe), helium (He) or neon (Ne) alone or in combination at a predetermined pressure. A region surrounded by the scanning electrodes 112, the sustaining electrodes 118, the first trace electrode 115, the second trace electrode 116, the data electrodes 120, the phosphor layer 122, and the discharge gas space defines a cell.

The scanning electrodes 112, the sustaining electrodes 113, the first trace electrode 115 and the second trace electrode 116 in the cell are identical in shape with those in a cell in the plasma display panel in accordance with the first embodiment, illustrated in FIG. 7. In addition, the dielectric layer 117 has the same cross-section as the cross-section of the dielectric layer 97 in the fifth embodiment, illustrated in FIG. 17.

Thus, it would be possible to have the same advantages as those obtained in the above-mentioned first and fifth embodiments, by driving the plasma display panel in the sixth embodiment, having the above-mentioned cell, in accordance with the method having been explained in the above-mentioned first embodiment. That is, a voltage difference in sustaining voltages in the sixth embodiment for controlling a sustaining discharge area is greater than the same in the first or fifth embodiment Accordingly, a sustaining discharge area could be controlled more readily in the sixth embodiment than in the above-mentioned first and fifth embodiments, ensuring that a plasma display panel can be driven more stably.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

An example of a variant of the first embodiment is explained hereinbelow.

For instance, in the above-mentioned first embodiment, the negative sustaining pulses $P_{SUN1}$ and $P_{SUN2}$ applied to all of the scanning and sustaining electrodes in the sustaining period Ts in a certain sub-field in a frame are designed to have an amplitude equal to the sustaining voltage Vsb, and the negative sustaining pulses $P_{SUN1}$ and $P_{SUN2}$ applied to all of the scanning and sustaining electrodes in the sustaining period Ts in another sub-field in the frame are designed to have an amplitude equal to the sustaining voltage $V_{SC}$. However, it should be noted that the negative sustaining pulses $P_{SUN1}$ and $P_{SUN2}$ applied to all of the scanning and sustaining electrodes in the sustaining period Is in one or more sub-fields in a frame may be designed to have an amplitude equal to the sustaining voltage Vsb, This ensures that a luminance in a cell or cells from which a light is emitted in all of sub-fields can be controlled without changing the total number of sustaining pulses.

For instance, it is assumed that when a frame comprised of eight sub-fields and having a certain average peak luminance (APL) is to be displayed in a plasma display panel, the numbers of sustaining pulses in the eight sub-fields are 1, 2, 4, 8, 16, 32, 64 and 128. Then, it is assumed that when a frame having an average peal luminance (APL) level higher than that of the above-mentioned frame is to be displayed in a plasma display panel, an amplitude of sustaining voltages in all of sub-fields is changed to the sustaining voltage $V_{SB}$ from the sustaining voltage $V_{SC}$ without the number of sustaining pulses in accordance with a method of this example. By doing so, a luminance of a cell or cells to be activated in all of sub-fields becomes about half, and hence, power consumption reduces down to about half. A ratio in a luminance of cells to be activated in each of sub-fields remains unchanged in comparison with a ratio determined before an amplitude of a sustaining voltage has been changed, and thus, it would be possible to display images at the unchanged number of gray scales.

In accordance with the above-mentioned example, since it is not necessary to change an amplitude of a sustaining voltage in a frame, a plasma display panel can be driven more readily than the method having been explained in the above-mentioned first embodiment. The method in accordance with the present example may be applied to the plasma display panels in accordance with the second to sixth embodiments.

In the above-mentioned first embodiment, the negative sustaining pulses to be applied to all of the scanning and sustaining electrodes in the sustaining period in a sub-field in a frame were designed to have a common amplitude. However, it should be noted that the negative sustaining pulses may be designed to have different amplitudes from one another in a sustaining period. This is because, in a sub-field in which a sustaining pulse is applied to all of scanning and sustaining electrodes a plurality of times in a sustaining period, it would be possible, by changing an amplitude of a sustaining voltage during a sustaining period, to display images at a plurality of intermediate gray scales between a maximum gray scale in the sub-field and a minimum gray scale equal to a half of the maximum gray scale in dependence on a ratio of the number of sustaining pulses to be applied before and after an amplitude is changed.

In a conventional method of controlling a luminance in a plasma display panel, assuming that a frame is comprised of eight sub-fields, in order to accurately equalize a ratio of a luminance in the eight sub -fields to a ratio of sustaining pulses of the eight sub-fields (for instance, 1:2:4:8:16:32:64:128), it would be necessary that the total number of sustaining pulses in a frame is equal to a multiple of 255 (for instance, 510 or 765). However, if the total number of sustaining pulses in a frame is selected among multiples of 255 in order to control a luminance, a luminance varies in a great degree, and hence, a luminance suddenly, significantly varied each time an image displayed in a plasma display panel is changed. Hence, a luminance in a conventional plasma display panel was controlled by further using a mode in which a ratio of sustaining pulses in each of the above-mentioned sub-fields is approximately equal to a ratio of 1:2:4:8:16:32:64:128.

In contrast, by changing an amplitude of a sustaining pulse in a sustaining period, it would be possible to accomplish a theoretical ratio of a luminance in each of sub-fields without using a multiple of the number of sustaining pulses.

Hereinbelow is explained the above-mentioned process through an example in which a frame is comprised of eight sub-fields, the number of sustaining pulses in each of the eight sub-fields is 2, 3, 6, 12, 24, 48, 96 and 192, respectively, and the total number of sustaining pulses is 383.

In a sustaining period of a sub-field in which the number of sustaining pulses is equal to two (2), if an amplitude of one of two negative sustaining pulses to be applied to scanning and sustaining electrodes is changed to a smaller one, a luminance in the sub-field becomes 0.75 times smaller than a luminance obtained when amplitudes of the two negative sustaining pulses remain unchanged.

Accordingly, a ratio of a luminance in the sub-fields is 1:2:4:8:16:32:64:128 with the total number of sustaining pulses remaining equal to 388, resulting in that images can be displayed at 256 gray scales.

As mentioned above, the above-mentioned method makes it possible to display a luminance not only with a multiple of the total number of sustaining pulses, but also with an intermediate number of sustaining pulses, even if a luminance is varied when an image displayed in a plasma display panel is changed. Thus, it is possible to control a luminance in accordance with a peak luminance enhancement (PLE) process without a significant change in a luminance, ensuring enhancement in a quality in displayed images.

The above-mentioned method may be applied to the plasma display panels in accordance with the above-mentioned second to sixth embodiments.

In the above-mentioned first to third embodiments, the two second parts are designed to make electrical contact at their distal ends with the first and second trace electrodes. As an alternative, there may be formed an additional first part on upper surfaces of the first and second trace electrodes. The additional first part extends in the column direction, and connects distal ends of the two second parts to each other. The additional first part reduces electrical resistance between the scanning and sustaining electrodes, and the first and second trace electrodes, and further reduces electrical resistance between the scanning and sustaining electrodes and a driver circuit.

Though the scanning and sustaining electrodes in the first to sixth embodiments are comprised of an electrically conductive transparent film, they may be comprised of a metal film such as a thick silver film or a thin aluminum or copper film, similarly to the first and second trace electrodes.

Though each of the scanning and sustaining electrodes in the above-mentioned second embodiment is designed to have two first parts, and each of the scanning and sustaining electrodes in the above-mentioned third embodiment is designed to have three first parts, each of the scanning and sustaining electrodes may be designed to have four or more first parts. In addition, the first parts may be spaced away from one another by a distance equal to a discharge gap, a distance smaller than a discharge gap, or a distance greater than a discharge gap.

Though the plasma display panel in accordance with the fourth embodiment is designed to include two scanning and sustaining electrodes, the plasma display panel may be designed to include three or more scanning and sustaining electrodes. The scanning and sustaining electrodes may be spaced away from one another by a distance equal to a discharge gap, a distance smaller than a discharge gap, or a distance greater than a discharge gap.

The dielectric layer in the above-mentioned fifth and sixth embodiments is designed to include the first portion including an area around a discharge gap and the second portion other than the first portion. The first portion has a thickness smaller than a thickness of the second portion. As an alternative, the first potion may be designed to have a dielectric constant higher than the same of the second portion. For instance, the first portion of a dielectric layer may be composed of a first material, and the second portion may be composed of a second material having a dielectric constant smaller than a dielectric constant of the first portion.

Each of the first to sixth embodiments may be applied to other embodiments, unless they are not contradictory to each other with respect to a structure and an object.

The -present invention may be reduced into practice in both a black-and-white plasma display panel and a color plasma display panel. The method and the driver circuit both in accordance with the present invention may be applied to both a black-and-white plasma display panel and a color plasma display panel.

The driver circuit for driving a plasma display panel, in accordance with the present invention, may be applied to a display unit including a plasma display panel, such as a display unit in a television set or a monitor of a computer.

The entire disclosure of Japanese Patent Application No. 2002-24487 filed on Jan. 31, 2001 including specification, claims, drawings and summary is incorporated herein by reference in its entirety.

What is claimed is:

1. A plasma display panel including a plurality of cells arranged in a matrix, wherein each of said cells includes:

(a) a scanning electrode having partial cutout;

(b) a sustaining electrode having partial cutout, spaced away from said scanning electrode by a discharge gap in mirror-symmetry with a centerline of said discharge gap extending in a first direction;

(c) a first trace electrode extending in said first direction on the opposite side of said scanning electrode about said discharge gap such that said first trace electrode makes electrical contact with said scanning electrode and further with a scanning electrode of an adjacent cell; and (d) a second trace electrode extending in said first direction on the opposite side of said sustaining electrode about said discharge gap such that said second trace electrode makes electrical contact with said sustaining electrode and further with a sustaining electrode of an adjacent cell.

2. The plasma display panel as set forth in claim 1, wherein said partial cutout defines an area of said cell in which sustaining discharge is most intensive.

3. The plasma display panel as set forth in claim 1, wherein said scanning electrode is comprised of a single first part facing said discharge gap and extending in said first direction, and two second parts extending in a second direction perpendicular to said first direction, and spaced away from each other in parallel, wherein said first part is connected at its opposite ends to said second parts, and each of said second parts makes electrical contact with said first trace electrode.

4. The plasma display panel as set forth in claim 3, wherein each of said second parts make electrical contact at distal ends thereof with said first trace electrode.

5. The plasma display panel as set forth in claim 1, wherein said sustaining electrode is comprised of a single first part facing said discharge gap and extending in said first direction, and two second parts extending in a second direction perpendicular to said first direction, and spaced away from each other in parallel, wherein said first part is connected at its opposite ends to said second parts, and each of said second parts makes electrical contact with said second trace electrode.

6. The plasma display panel as set forth in claim 3, wherein each of said second parts make electrical contact at distal ends thereof with said second trace electrode.

7. The plasma display panel as set forth in claim 1, wherein said scanning electrode is comprised of a plurality of first parts extending in said first direction, and two second parts extending in a second direction perpendicular to said first direction, and spaced away from each other in parallel, wherein said first part is connected at its opposite ends to said second parts, one of said first parts faces said discharge gap, and the rest of said first parts are spaced away from one another at the opposite side of said one of said first parts about said discharge gap, and each of said second parts makes electrical contact with said first trace electrode.

8. The plasma display panel as set forth in claim 7, wherein said first parts are equal in width to one another.

9. The plasma display panel as set forth in claim 7, wherein said first parts are equally spaced away from one another.

10. The plasma display panel as set forth in claim 7, wherein one of said first parts is located on said first trace electrode in electrical contact.

11. The plasma display panel as set forth in claim 1, wherein said sustaining electrode is comprised of a plurality of first parts extending in said first direction, and two second parts extending in a second direction perpendicular to said first direction, and spaced away from each other in parallel, wherein each of said first parts is connected at its opposite ends to said second parts, one of said first parts faces said discharge gap, and the rest of said first parts are spaced away from one another at the opposite side of said one of said first parts about said discharge gap, and each of said second parts makes electrical contact with said second trace electrode.

12. The plasma display panel as set forth in claim 11, wherein said first parts are equal in width to one another.

13. The plasma display panel as set forth in claim 11, wherein said first parts are equally spaced away from one another.

14. The plasma display panel as set forth in claim 11, wherein one of said first parts is located on said second trace electrode in electrical contact.

15. The plasma display panel as set forth in claim 1, wherein said scanning electrode, said sustaining electrode, and said first and second trace electrodes are formed on an electrically insulating substrate, and further comprising a dielectric layer formed on said electrically insulating substrate, covering said scanning electrode, said sustaining electrode, and said first and second trace electrodes therewith, said dielectric layer being comprised of a first portion covering therewith an area including said discharge gap, and a second portion other than said first portion, said first portion having a thickness smaller than a thickness of said second portion.

16. The plasma display panel as set forth in claim 1, wherein said scanning electrode, said sustaining electrode, and said first and second trace electrodes are formed on an electrically insulating substrate, and further comprising a dielectric layer formed on said electrically insulating substrate, covering said scanning electrode, said sustaining electrode, and said first and second trace electrodes therewith, said dielectric layer being comprised of a first portion covering therewith an area including said discharge gap, and a second portion other than said first portion, said first portion having a dielectric constant higher than the same of said second portion.

17. The plasma display panel as set forth in claim 1, wherein each of said scanning and sustaining electrodes is comprised of a electrically conductive transparent thin film, and each of said first and second trace electrodes is comprised of a metal film.

18. A plasma display panel including a plurality of cells arranged in a matrix, wherein each of said cells includes:

(a) a first scanning electrode extending in a first direction;

(b) a first sustaining electrode spaced away from said first scanning electrode by a discharge gap, and extending in said first direction;

(c) at least one second scanning electrode spaced away from said first scanning electrode at the opposite side of said first scanning electrode about said discharge gap;

(d) at least one second sustaining electrode spaced away from said first sustaining electrode at the opposite side of said first sustaining electrode about said discharge gap;

(e) a first trace electrode comprised of a single first part extending in said first direction, and two second parts extending in a second direction perpendicular to said first direction above partition walls extending in said direction for partitioning said cells, said first part and second parts being connected to each other above said partition walls, said first part being spaced away from a second scanning electrode remotest from said discharge gap among said at least one second scanning electrode, said first and second scanning electrodes making electrical contact with said second parts above said partition walls; and (f) a second trace electrode comprised of a single first part extending in said first direction, and two second parts extending in said second direction above said partition walls, said first part and second parts being connected to each other above said partition walls, said first part being spaced away from a second sustaining electrode remotest from said discharge gap among said at least one second sustaining electrode, said first and second sustaining electrodes making electrical contact with said second parts above said partition walls.

19. The plasma display panel as set forth in claim 18, wherein said plasma display panel includes a plurality of second scanning electrodes which are equal in width to one another.

20. The plasma display panel as set forth in claim 18, wherein said plasma display panel includes a plurality of second sustaining electrodes which are equal in width to one another.

21. The plasma display panel as set forth in claim 18, wherein said first and second scanning electrodes, said first and second sustaining electrodes, and said first and second trace electrodes are formed on an electrically insulating substrate, and further comprising a dielectric layer formed on said electrically insulating substrate, covering said first and second scanning electrodes, said first and second sustaining electrodes, and said first and second trace electrodes therewith, said dielectric layer being comprised of a first portion covering therewith an area including said discharge gap, and a second portion other than said first portion, said first portion having a thickness smaller than a thickness of said second portion.

22. The plasma display panel as set forth in claim 18, wherein said first and second scanning electrodes, said first and second sustaining electrodes, and said first and second trace electrodes are formed on an electrically insulating substrate, and further comprising a dielectric layer formed on said electrically insulating substrate, covering said first and second scanning electrodes, said first and second sustaining electrodes, and said first and second trace electrodes therewith, said dielectric layer being comprised of a first portion covering therewith an area including said discharge gap, and a second portion other than said first portion, said first portion having a dielectric constant higher than the same of said second portion.

23. The plasma display panel as set forth in claim 18, wherein each of said first and second scanning electrodes and each of said first and second sustaining electrodes are comprised of a electrically conductive transparent thin film, and each of said first and second trace electrodes is comprised of a metal film.

24. A method of driving a plasma display panel defined in claim 1, including the step of changing the number of sustaining pulses to be applied to said scanning and sustaining electrodes in a sustaining period in at least one sub-field among a plurality of sub-fields constituting a frame, for displaying images in a gray scale, wherein a curve indicating a relation between a luminance and a sustaining voltage in said cell includes at least one intermediate region in which a luminance remains almost unchanged even if said sustaining voltage is increased, and said sustaining pulses have an amplitude equal to said sustaining voltage.

25. A method of driving a plasma display panel defined in claim 18, including the step of changing the number of sustaining pulses to be applied to said first and second scanning electrodes and said first and second sustaining electrodes in a sustaining period in at least one sub-field among a plurality of sub-fields constituting a frame, for displaying images in a gray scale, wherein a curve indicating a relation between a luminance and a sustaining voltage in said cell includes at least one intermediate region in which a luminance remains almost unchanged even if said sustaining voltage is increased, and said sustaining pulses have an amplitude equal to said sustaining voltage.

26. A method of driving a plasma display panel defined in claim 1, including the step of changing the number of sustaining pulses to be applied to said scanning and sustaining electrodes in a sustaining period in at least one sub-field among a plurality of sub-fields constituting a frame, for displaying images in a gray scale, wherein a curve indicating a relation between a luminance and a sustaining voltage in said cell includes at least one intermediate region in which a luminance remains almost unchanged even if said sustaining voltage is increased, and one of said sustaining pulses has an amplitude equal to said sustaining voltage.

27. A method of driving a plasma display panel defined in claim 18, including the step of changing the number of sustaining pulses to be applied to said first and second scanning electrodes and said first and second sustaining electrodes in a sustaining period in at least one sub-field among a plurality of sub-fields constituting a frame, for displaying images in a gray scale, wherein a curve indicating a relation between a luminance and a sustaining voltage in said cell includes at least one intermediate region in which a luminance remains almost unchanged even if said sustaining voltage is increased, and one of said sustaining pulses has an amplitude equal to said sustaining voltage.

28. A circuit for driving a plasma display panel defined in claim 1 by changing the number of sustaining pulses to be applied to said scanning and sustaining electrodes in a sustaining period in at least one sub-field among a plurality of sub-fields constituting a frame, for displaying images in a gray scale, said circuit including:

(a) a first circuit for operating an average luminance level of image data per a frame;

(b) a second circuit for transmitting, based on the results of operation having been carried out by said first circuit, data indicative the total number of sustaining pulses in said frame in accordance with said average luminance level, and data indicative of the number of sustaining pulses for each of sub-fields which number determines a luminance in each of said cells;

(c) a third circuit for selecting, based on said results and said total number of sustaining pulses, one of an amplitude of a first sustaining voltage close to a voltage at which a luminance is saturated, and an amplitude of a certain period of second sustaining amplitude in which a luminance remains almost unchanged even if said sustaining voltage is increased, as an amplitude of a sustaining voltage in each of said sub-fields, and for transmitting an amplitude selection signal indicative of the thus selected amplitude; and (d) a fourth circuit for producing image data by which said plasma display panel is driven, based on said image data, in accordance with said amplitude selection signal, wherein an amplitude of said second sustaining voltage is selected as an amplitude of a sustaining pulse to be applied to said scanning and sustaining electrodes in a sustaining period in at least one sub-field among said plurality of sub-fields.

29. A circuit for driving a plasma display panel defined in claim 18 by changing the number of sustaining pulses to be applied to said first and second scanning electrodes and said first and second sustaining electrodes in a sustaining period in at least one sub-field among a plurality of sub-fields constituting a frame, for displaying images in a gray scale, said circuit including:

(a) a first circuit for operating an average luminance level of image data per a frame;

(b) a second circuit for transmitting, based on the results of operation having been carried out by said first circuit, data indicative the total number of sustaining pulses in said frame in accordance with said average luminance level, and data indicative of the number of sustaining pulses for each of sub-fields which number determines a luminance in each of said cells;

(c) a third circuit for selecting, based on said results and said total number of sustaining pulses, one of an amplitude of a first sustaining voltage close to a voltage at which a luminance is saturated, and an amplitude of a certain period of second sustaining amplitude in which a luminance remains almost unchanged even if said sustaining voltage is increased, as an amplitude of a sustaining voltage in each of said sub-fields, and for transmitting an amplitude selection signal indicative of the thus selected amplitude; and (d) a fourth circuit for producing image data by which said plasma display panel is driven, based on said image data, in accordance with said amplitude selection signal, wherein an amplitude of said second sustaining voltage is selected as an amplitude of a sustaining pulse to be applied to said first and second scanning electrodes and said first and second sustaining electrodes in a sustaining period in at least one sub-field among said plurality of sub-fields.

30. A circuit for driving a plasma display panel defined in claim 1 by changing the number of sustaining pulses to be applied to said scanning and sustaining electrodes in a sustaining period in at least one sub-field among a plurality of sub-fields constituting a frame, for displaying images in a gray scale, said circuit including:

(a) a first circuit for operating an average luminance level of image data per a frame;

(b) a second circuit for transmitting, based on the results of operation having been carried out by said first circuit, data indicative the total number of sustaining pulses in said frame in accordance with said average luminance level, and data indicative of the number of sustaining pulses for each of sub-fields which number determines a luminance in each of said cells;

(c) a third circuit for selecting, based on said results and said total number of sustaining pulses, one of an amplitude of a first sustaining voltage close to a voltage at which a luminance is saturated, and an amplitude of a certain period of second sustaining amplitude in which a luminance remains almost unchanged even if said sustaining voltage is increased, as an amplitude of a sustaining voltage in each of said sub-fields, and for transmitting an amplitude selection signal indicative of the thus selected amplitude; and (d) a fourth circuit for producing image data by which said plasma display panel is driven, based on said image data, in accordance with said amplitude selection signal, wherein an amplitude of said second sustaining voltage is selected as an amplitude of one of sustaining pulses to be applied to said scanning and sustaining electrodes in a sustaining period in at least one sub-field among said plurality of sub-fields.

31. A circuit for driving a plasma display panel defined in claim 18 by changing the number of sustaining pulses to be applied to said first and second scanning electrodes and said first and second sustaining electrodes in a sustaining period in at least one sub-field among a plurality of sub-fields constituting a frame, for displaying images in a gray scale, said circuit including:

(a) a first circuit for operating an average luminance level of image data per a frame;

(b) a second circuit for transmitting, based on the results of operation having been carried out by said first circuit, data indicative the total number of sustaining pulses in said frame in accordance with said average luminance level, and data indicative of the number of sustaining pulses for each of sub-fields which number determines a luminance in each of said cells;

(c) a third circuit for selecting, based on said results and said total number of sustaining pulses, one of an amplitude of a first sustaining voltage close to a voltage at which a luminance is saturated, and an amplitude of a certain period of second sustaining amplitude in which a luminance remains almost unchanged even if said sustaining voltage is increased, as an amplitude of a sustaining voltage in each of said sub-fields, and for transmitting an amplitude selection signal indicative of the thus selected amplitude; and (d) a fourth circuit for producing image data by which said plasma display panel is driven, based on said image data, in accordance with said amplitude selection signal, wherein an amplitude of said second sustaining voltage is selected as an amplitude of one of sustaining pulses to be applied to said first and second scanning electrodes and said first and second sustaining electrodes in a sustaining period in at least one sub-field among said plurality of sub-fields.

32. A plasma display unit comprising a plasma display panel defined in claim 1, and a circuit defined in claim 28.

33. A plasma display unit comprising a plasma display panel defined in claim 1, and a circuit defined in claim 30.

34. A plasma display unit comprising a plasma display panel defined in claim 18, and a circuit defined in claim 29.

35. A plasma display unit comprising a plasma display panel defined in claim 18, and a circuit defined in claim 31.

* * * * *